US006825740B2

(12) United States Patent
Kundu

(10) Patent No.: US 6,825,740 B2
(45) Date of Patent: Nov. 30, 2004

(54) TEM DUAL-MODE RECTANGULAR DIELECTRIC WAVEGUIDE BANDPASS FILTER

(75) Inventor: Arun Chandra Kundu, Tokyo (JP)

(73) Assignee: TDK Corporation, Tokyo (JP)

( * ) Notice: Subject to any disclaimer, the term of this patent is extended or adjusted under 35 U.S.C. 154(b) by 158 days.

(21) Appl. No.: 10/071,724

(22) Filed: Feb. 8, 2002

(65) Prior Publication Data

US 2003/0151472 A1 Aug. 14, 2003

(51) Int. Cl.[7] ..... H01P 1/20
(52) U.S. Cl. ..... 333/202; 333/204; 333/205
(58) Field of Search ..... 333/202–212

(56) References Cited

U.S. PATENT DOCUMENTS

| | | | | |
|---|---|---|---|---|
| 4,963,844 A | * | 10/1990 | Konishi et al. | 333/208 |
| 5,136,268 A | * | 8/1992 | Fiedziuszko et al. | 333/204 |
| 5,750,473 A | * | 5/1998 | Shen | 505/210 |
| 6,556,109 B2 | * | 4/2003 | Kanba et al. | 333/204 |
| 6,563,403 B2 | * | 5/2003 | Kanba et al. | 333/204 |

OTHER PUBLICATIONS

Decker et al "Multichip MMIC Package for X and Ka Band" Feb. 1997, IEEE Transactions on Component, Packaging, and Manufacturing Technology Part B, vol. 20, No. 1 pp. 27–33.*

K. Sano and M. Miyashita, "Application of the Planar I/O Terminal to Dual–Mode Dielectric–Waveguide Filters;" IEEE Transactions on Microwave Theory and Techniques, vol. 48, No. 12, pp. 2491–2495, Dec. 2000, USA.

A.C. Kundu and I. Awai, "Resonant Frequency and Quality Factors of a Silver–Coated 2/ 4 Dielectric Waveguide Resonator," IEEE Transactions on Microwave Theory and Techniques, vol. 46, No. 8, pp. 1124–1131, Aug. 1998, USA.

I. Awai, A.C. Kundu and T. Yamashita, "Equivalent–Circuit Representation and Explanation of Attenuation Poles of a Dual–Mode Dielectric–Resonator Bandpass Filter," IEEE Transactions on Microwave Theory and Techniques, vol. 46, No. 12, pp. 2159–2163, Dec. 1998, USA.

(List continued on next page.)

*Primary Examiner*—Robert Pascal
*Assistant Examiner*—Kimberly Glenn
(74) *Attorney, Agent, or Firm*—Brown Raysman Millstein Felder & Steiner LLP

(57) ABSTRACT

Thin type TEM dual-mode rectangular-planar dielectric waveguide bandpass filter is disclosed.

The bandpass filter disclosed in the specification is constituted of a dielectric block 11 having a top surface, a bottom surface and first to fourth side surfaces, a metal plate 12 to be in a floating state substantially entirely formed on the top surface of the dielectric block 11, a metal plate 13 to be grounded formed on the bottom surface of the dielectric block 11, and exciting electrodes 14 and 15 formed on the bottom surface of the dielectric block 11. The metal plate 13 has a removed portion 16 exposing a part of the bottom surface of the dielectric block 11. The removed portion 16 destroys the symmetry of the resonator structure of each mode so that a coupling between the dual-mode is provided. According to this structure, because the exciting electrodes 14 and 15 are formed on the bottom surface of the dielectric block 11, thickness of the dielectric block 11 can be easily reduced.

36 Claims, 19 Drawing Sheets

OTHER PUBLICATIONS

J.A. Curtis and S.J. Fiedziuszko, "Miniature Dual Mode Microstrip Filters," 1991 IEEE MTT–S Digest, pp. 443–445, Jun. 1991, USA.

S.J. Fiedziuszko, J.A. Curtis, S.C. Holme and R. Kwok, "Low Loss Multiplexers with Planar Dual Mode HTS Resonators," IEEE Transactions on Microwave Theory and Techniques, vol. 44, No. 7, pp. 1248–1257, Jul. 1996, USA.

L.S. Napoli and J.J. Hughes, "A Simple Technique for the Accurate Determination of the Micorwave Dielectric Constant for Microwave Integrated Circuit Substrates," IEEE Transactions on Microwave Theory and Techniques, pp. 664–665, Jul. 1971, USA.

J. Watkins, "Radiation Loss from Open–Circuited Dielectric Resonators," IEEE Transactions on Microwave Theory and Techniques, pp. 636–639, Oct. 1973, USA.

I. Awai and A.C. Kundu, "Distributed Coupling of Dual–Modes in a Circular Resonator and Low–Profile Dielectric Disk Resonator BPF," IEICE Transactions on Electronics, vol. E82–C, No. 2, pp. 393–401, Feb. 1999, Japan.

A.C. Kundu and I. Awai, "Low–Profile Dual–Mode BPF Using Square Dielectric Disk Resonator," Proceedings of the 1997 Chugoku–region Autumn Joint Conference of 5 Institutes. Hiroshima, Japan, Oct. 1997, Japan.

* cited by examiner

TEM DUAL-MODE RECTANGULAR DIELECTRIC WAVEGUIDE BANDPASS FILTER

BACKGROUND OF THE INVENTION

The present invention relates to a bandpass filter, and particularly, to a TEM dual-mode rectangular-planar dielectric waveguide bandpass filter.

DESCRIPTION OF THE PRIOR ART

In recent years, marked advances in miniaturization of communication terminals, typically mobile phones, has been achieved thanks to miniaturization of the various components incorporated therein One of the most important components incorporated in a communication terminal is a filter component.

As one type of filter component, TEM dual-mode dielectric waveguide filters are known (A. C. Kundu and I. Awai, "Low-Profile Dual-Mode BPF Using Square Dielectric Disk Resonator," Proceedings of the 1997 Chugoku-region Autumn Joint Conference of 5 Institutes, Hiroshima, Japan, October 1997, page 272). Since the TEM dual-mode dielectric waveguide filter acts as two resonators, i.e., two different modes of the resonator have the same resonant frequency, it can be used as a small and high performance bandpass filter.

However, since the TEM dual-mode dielectric waveguide filter of the above-mentioned type is electrically connected to a printed circuit board by wires, there is the problem that it occupies a relatively wide area. Further, since the electrodes to which the wires are to be connected are disposed on the side surfaces of the dielectric block, for thin types it is difficult to obtain sufficient external circuit coupling and/or it is difficult to perform a wire bonding.

Moreover, since the TEM dual-mode dielectric waveguide filter of the above-mentioned type has the removed portion on the metal plate which is floating for controlling the coupling, there is the further problem that the radiation loss increases with increasing the area of the removed portion so as to enhance the coupling.

SUMMARY OF THE INVENTION

It is therefore an object of the present invention to provide an improved TEM dual-mode dielectric waveguide bandpass filter.

Another object of the present invention is to provide a very thin TEM dual-mode dielectric waveguide bandpass filter.

A further object of the present invention is to provide a TEM dual-mode dielectric waveguide bandpass filter which requires a small area for mounting.

A still further object of the present invention is to provide a TEM dual-mode dielectric waveguide bandpass filter having sufficient external circuit coupling. A still further object of the present invention is to provide a TEM dual-mode dielectric waveguide bandpass filter in which the radiation loss is decreased.

The above and other objects of the present invention can be accomplished by a bandpass filter of dual modes comprising a dielectric block having a top surface, a bottom surface and first to fourth side surfaces, a first metal plate to be in a floating state substantially entirely formed on the top surface of the dielectric block, a second metal plate to be grounded formed on the bottom surface of the dielectric block, and means for providing a coupling between the dual modes.

According to the present invention, because the top surface of the dielectric block is substantially entirely covered with the first metal plate to be in a floating state, the radiation loss can be reduced.

In a preferred aspect of the present invention, the providing means is achieved by a removed portion exposing a part of the bottom surface of the dielectric block.

In another preferred aspect of the present invention, the providing means is achieved by a coupling control stub formed on the bottom surface of the dielectric block and physically connected to the second metal plate.

In still another preferred aspect of the present invention, the providing means is achieved by a third removed portion exposing still another part of the bottom surface of the dielectric block.

In a further preferred aspect of the present invention, the bandpass filter further comprises a first exciting electrode and a second exciting electrode formed on the bottom surface of the dielectric block.

According to this preferred aspect of the present invention, because the exciting electrodes are disposed on the bottom surface of the dielectric block, the thickness there of the dielectric block and the area for mounting can be reduced. Moreover, because sufficient external circuit coupling can be obtained, a very thin shape and broadband operation can be achieved simultaneously.

In another preferred aspect of the present invention, the bandpass filter further comprises a first exciting electrode formed on the first side surface of the dielectric block and a second exciting electrode formed on the second side surface adjacent to the first side surface of the dielectric block The above and other objects of the present invention can be also accomplished by a bandpass filter of dual mode comprising a dielectric block having a top surface, a bottom surface and first to fourth side surfaces, a first metal plate formed on the top surface of the dielectric block, a second metal plate formed on the bottom surface of the dielectric block, first and second exciting electrodes formed on the bottom surface of the dielectric block, and means for providing a coupling between the dual modes.

According to the present invention, because the exciting electrodes are disposed on the bottom surface of the dielectric block, the thickness there of the dielectric block and the area for mounting can be reduced. Moreover, because sufficient external circuit coupling can be obtained, a very thin shape and broadband operation can be achieved simultaneously.

In a preferred aspect of the present invention, the providing means is achieved by a removed portion exposing a part of the bottom surface of the dielectric block.

In another preferred aspect of the present invention, the providing means is achieved by a coupling control stub formed on the bottom surface of the dielectric block and physically connected to the second metal plate.

In still another preferred aspect of the present invention, the providing means is achieved by a third removed portion exposing still another part of the bottom surface of the dielectric block.

The above and other objects and features of the present invention will become apparent from the following description made with reference to the accompanying drawings.

DESCRIPTION OF THE PREFERRED EMBODIMENT

Preferred embodiments of the present invention will now be explained with reference to the drawings.

Figure 1:
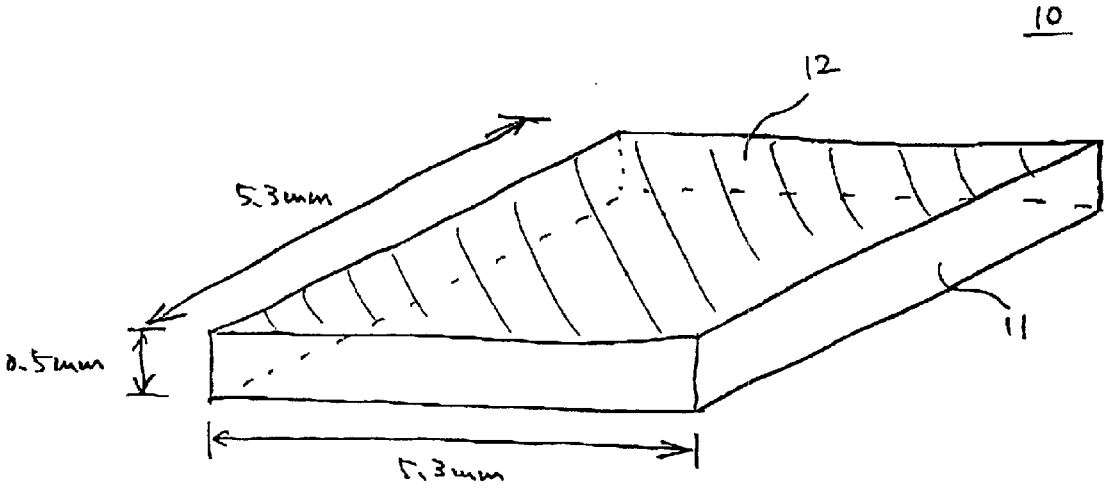
FIG. 1 is a schematic perspective view from a top side showing a bandpass filter 10 that is a preferred embodiment of the present invention.
Figure 2:
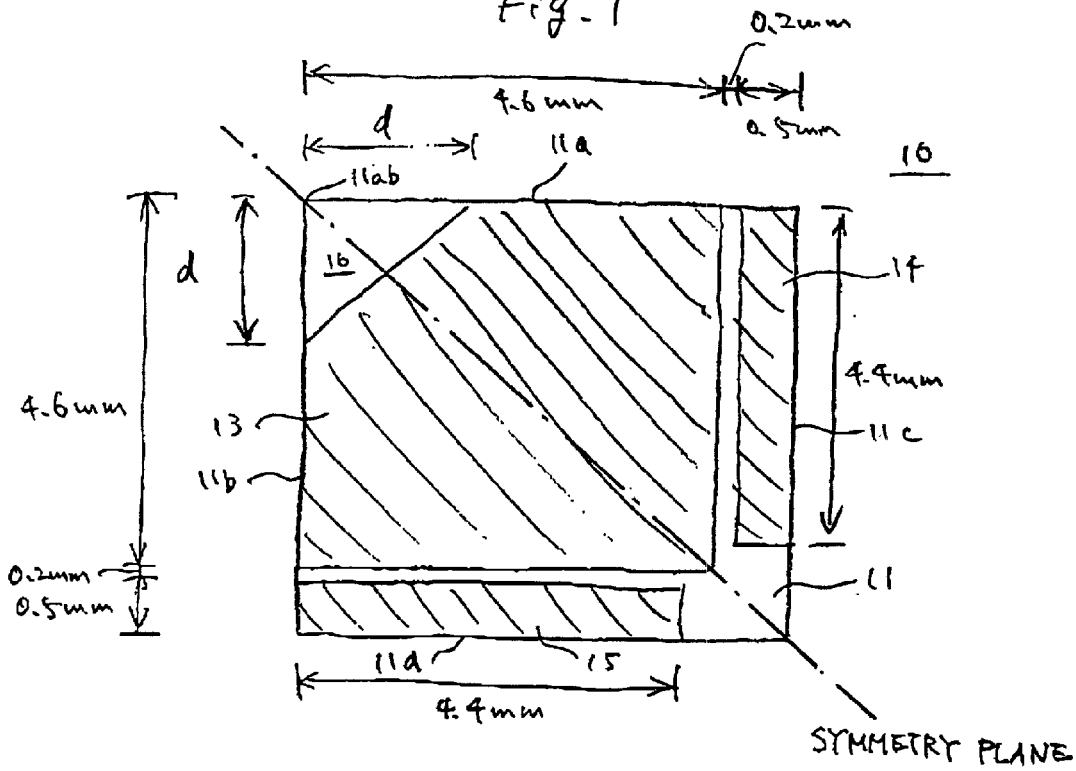
FIG. 2 is a schematic plan view from a bottom side showing the bandpass filter 10.

FIG. 1 is a schematic perspective view from a top side showing a bandpass filter 10 that is a preferred embodiment of the present invention. FIG. 2 is a schematic plan view from a bottom side showing the bandpass filter 10.

As shown in FIGS. 1 and 2, a bandpass filter 10 that is a preferred embodiment of the present invention is constituted of a dielectric block 11 and various metal plates formed on the surface thereof. The dielectric block 11 is made of dielectric material whose dielectric costant is 33, ($\square_r$=33), and has the shape of a rectangular prism whose length, width, and thickness are 5.3 mm, 5.3 mm, and 0.5 mm. respectively. That is, the dielectric block 11 has no holes or surface irregularities.

A metal plate 12 is formed on the top surface of the dielectric block 11. A metal plate 13 and exciting electrodes 14 and 15 are formed on the bottom surface of the dielectric block 11, As shown in FIG. 1, the metal plate 12 is formed on the entire top surface of the dielectric block 11, so that the dimension of the metal plate 12 is 5.3 mm×5.3 mm square. As shown in FIG. 2, the dimension of the metal plate 13 is 4.6 mm×4.6 mm square along the edge 11*a* and the edge 11*b* adjacent to the edge 11*a* of the bottom surface of the dielectric block 11 having a removed portion 16 of triangular positioned at the corner 11*ab* formed by the edges 11*a* and 11*b* where the edge of the removed portion 16 measures d. The exciting electrode 14 is located along the edge 11*a* and the edge 11*c* opposite to the edge 11*b* and the dimension of the exciting electrode 14 measures 0.5 mm×4.4 mm rectangular. The exciting electrode 15 is located along the edge 11*b* and the edge 11*d* opposite to the edge 11*a* and the dimension of the exciting electrode 15 measures 0.5 mm×4.4 mm rectangular.

As shown in FIG. 2, the metal plate 13 and the exciting electrode 14 are prevented from contacting each other by a 0.2 mm gap. Similarly, the metal plate 13 and the exciting electrode 15 are prevented from contacting each other by a 0.2 mm gap.

In actual use, the metal plate 12 formed on the top surface of the dielectric block 11 is floating and the metal plate 13 formed on the bottom surface of the dielectric block 11 is grounded. One of the exciting electrodes 14 and 15 is used as an input electrode, and the other is used as an output electrode.

The metal plates 12 and 13 and the exciting electrodes 14 and 15 are made of silver. However, the present invention is not limited to using silver and other kinds of metal can be used instead. It is preferable to use a screen printing method to form them on the surfaces of the dielectric block 11.

No metal plate or electrode is formed on the remaining surfaces of the dielectric block 11, which therefore constitute open ends. That is, no metal plate or electrode is formed any side surfaces of the dielectric block 11. Thus, the bandpass filter 10 can be fabricated by metallizing the top and bottom surfaces of the dielectric block 11.

According to the above described structure, the bandpass filter 10 of this preferred embodiment acts as a TEM dual-mode rectangular-planar dielectric waveguide bandpass filter.

The principle of the bandpass filter 10 will now be explained.

Figure 3:
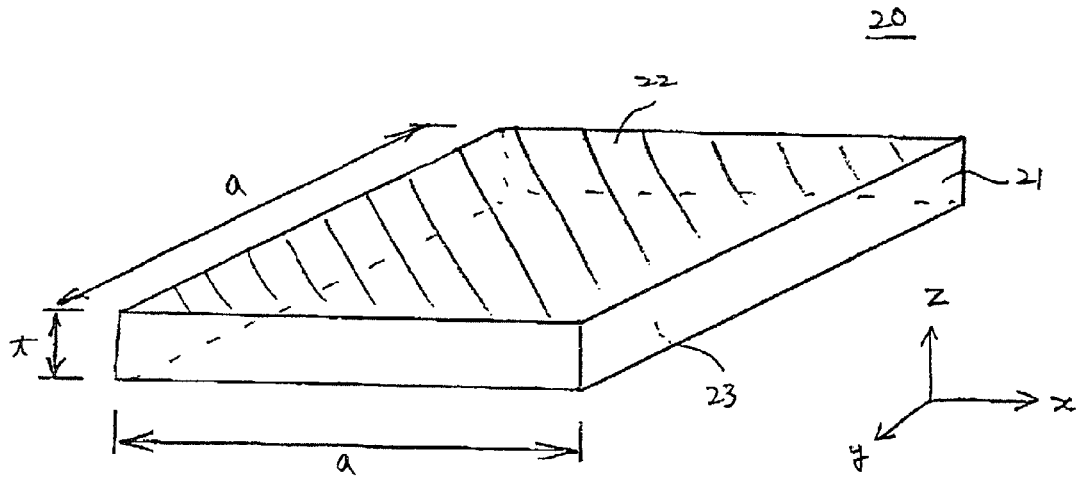
FIG. 3 is a schematic perspective view showing a TEM dual-mode rectangular-planar dielectric waveguide resonator 20.

FIG. 3 is a schematic perspective view showing a TEM dual-mode rectangular-planar dielectric waveguide resonator 20.

As shown in FIG. 3, the TEM dual-mode rectangular-planar dielectric waveguide resonator 20 is constituted of a dielectric block 21 whose bottom surface is a×a square and whose thickness is t, a metal plate 22 formed on the entire top surface of the dielectric block 21 and a metal plate 23 formed on the entire bottom surface of the dielectric block 21. The metal plate 22 formed on the top surface of the dielectric block 21 is floating and the metal plate 23 formed on the bottom surface of the dielectric block 21 is grounded. Remaining four side surfaces are open to the air.

In a TEM dual-mode rectangular-planar dielectric waveguide resonator 20 having the above-described structure has two propagation directions, i.e., along the x- and y-directions. Since the length along the x-direction and the length along the y-direction of the dielectric block 21 are the same, dominant resonant frequencies based on the propagation along the x-direction and the y-direction are substantially coincident. Therefore, the TEM dual-mode rectangular planar dielectric waveguide resonator 20 acts as two resonators (dual modes) having the same dominant resonant frequency from an electrical point of view. However, since there is no coupling between the dual modes, the TEM dual-mode rectangular-planar dielectric waveguide resonator 20 does not act as a filter.

Coupling between the dual modes can be provided by destroying the symmetry of the resonator structure of each mode in order for the TEM dual-mode rectangular-planar dielectric waveguide resonator 20 to act as a filter.

Figure 4:
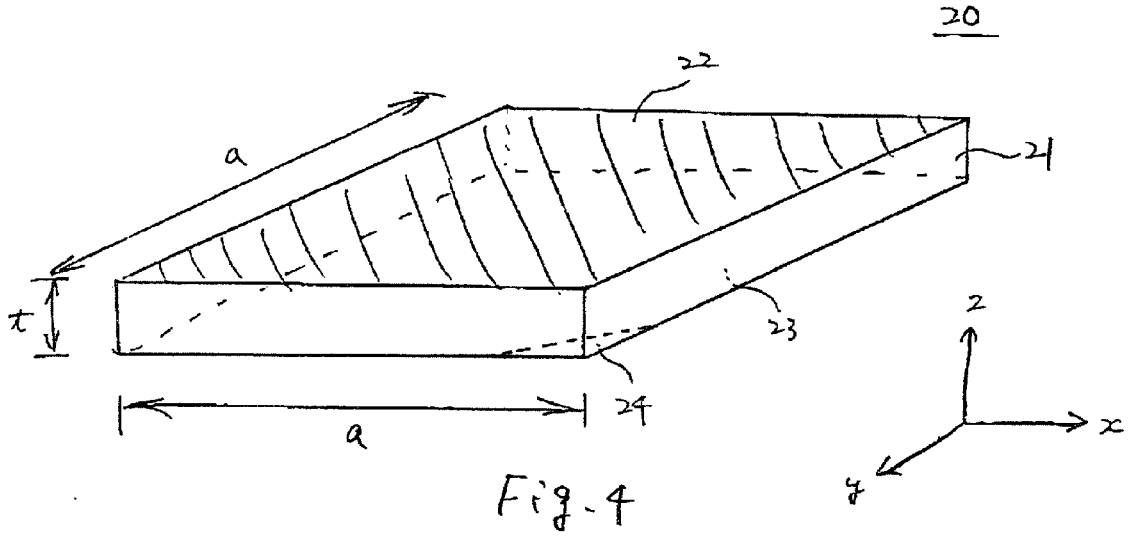
FIG. 4 is a schematic perspective view showing the TEM dual-mode rectangular-planar dielectric waveguide resonator 20 having a removed portion 24 on a metal plate 23.

FIG. 4 is a schematic perspective view showing the TEM dual-mode rectangular-planar dielectric waveguide resonator 20 having a removed portion 24 on a metal plate 23. The dielectric block 21 is exposed at the removed portion 24.

As shown in FIG. 4, the symmetry of the resonator structure of each mode can be affected by forming the removed portion 24 by removing a part of the metal plate 23 formed on the bottom surface of the dielectric block 21. It is preferable to locate the removed portion 24 at the corner of the metal plate 23 as shown in FIG. 4. Because the symmetry of the resonator structure of each mode is greatly destroyed with increasing the area of the removed portion 24, the coupling between the dual modes increases as the area of the removed portion 24 is increased. As is set out above, a filter function can be added to the TEM dual-mode rectangular-planar dielectric waveguide resonator 20 by forming the removed portion 24 on the metal plate 23 to thereby destroy the symmetry of the resonator structure of each mode.

The method for exciting the TEM dual-mode rectangular-planar dielectric waveguide resonator 20 will now be explained.

Figure 5:
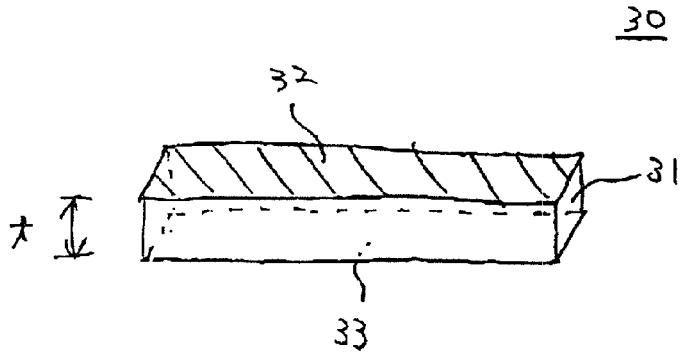
FIG. 5 is a schematic perspective view showing a capacitor 30 for exciting the TEM dual-mode rectangular-planar dielectric waveguide resonator 20.

FIG. 5 is a schematic perspective view showing a capacitor 30 for exciting the TEM dual-mode rectangular-planar dielectric waveguide resonator 20.

As shown in FIG. 5, the capacitor 30 is constituted of a dielectric block 31 whose thickness is t, a metal plate 32 formed on the entire top surface of the dielectric block 31 and a metal plate 33 formed on the entire bottom surface of the dielectric block 31. The metal plate 32 formed on the top surface of the dielectric block 31 is a metal plate to be connected to the metal plate 22 formed on the top surface of the dielectric block 21. The metal plate 33 formed on the bottom surface of the dielectric block 31 is the exciting electrode. The remaining four side surfaces are open to the air.

A bandpass filter can be configured by combining the capacitor 30 to the TEM dual-mode rectangular-planar dielectric waveguide resonator 20. In this case, a dielectric block for a spacer is required between the TEM dual-mode rectangular-planar dielectric waveguide resonator 20 and the capacitor 30 to prevent the metal plate 23 formed on the bottom surface of the dielectric block 21 and the metal plate 33 formed on the bottom surface of the dielectric block 31 from connecting with each other.

Figure 6:
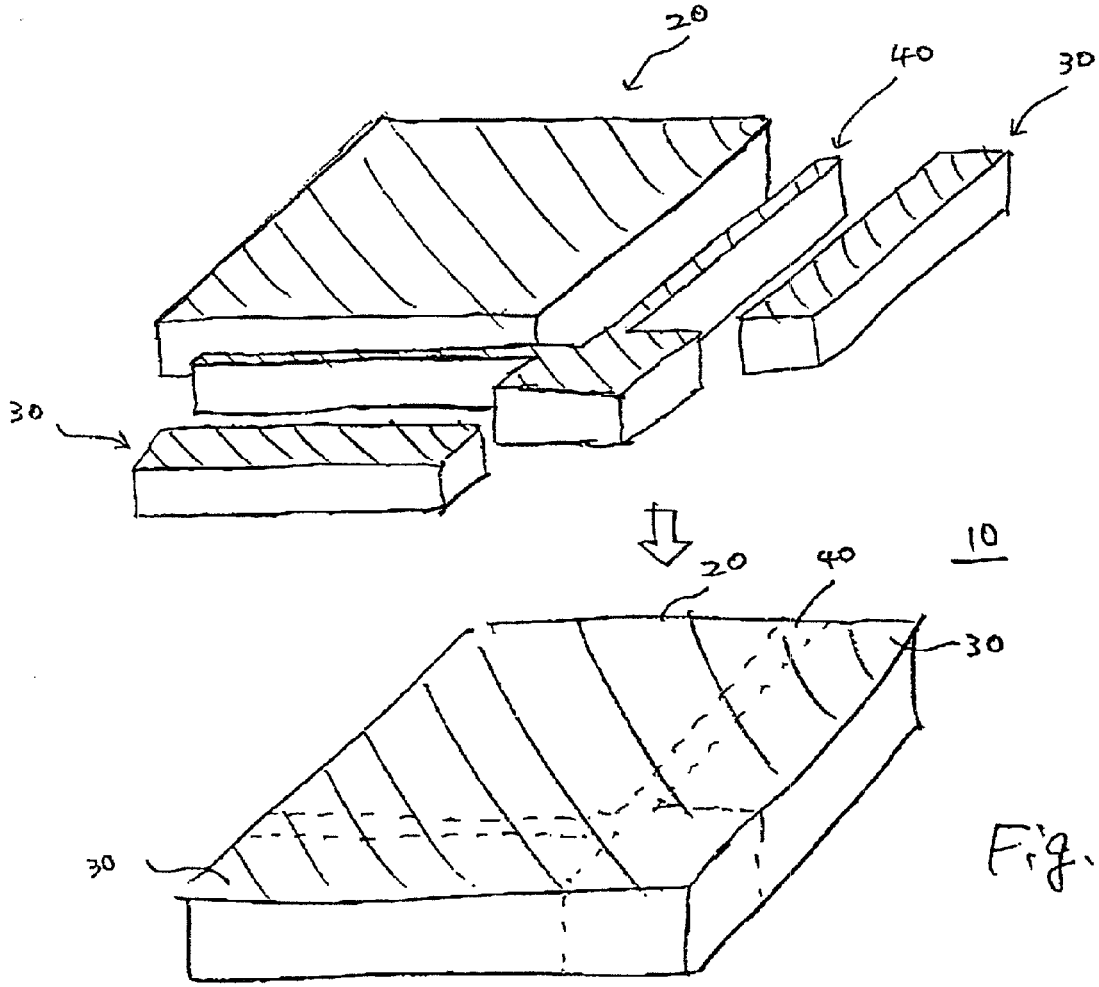
FIG. 6 is a conceptual diagram to form the bandpass filter 10 by combining the TEM dual-mode rectangular-planar dielectric waveguide resonator 20, and the capacitor 30 and a spacer 40.

FIG. 6 is a conceptual diagram to form the bandpass filter 10 by combining the TEM dual-mode rectangular-planar dielectric waveguide resonator 20, and the capacitor 30 and a spacer 40. It is worth noting that FIG. 6 is a conceptual diagram so that the bandpass filter 10 is not actually fabricated by combining the physical components of the resonator 20, the capacitor 30 and the spacer 40. Actually, the bandpass filter 10 can be fabricated by metallizing the top and bottom surfaces of the dielectric block 11 as a single component.

As shown in FIG. 6, in the bandpass filter 10 by conceptually combining the components of the resonator 20, the capacitor 30 and the spacer 40, the radiation loss from the top surface of the dielectric is small because the top surface of the dielectric block is entirely covered with the metal plate. The structure of the bottom surface is already shown in FIG. 2. Specifically, the metal plate 23 shown in FIG. 4 corresponds to the metal plate 13, the metal plates 33 shown in FIG. 5 correspond to the exciting electrodes 14 and 15.

This is the principle of the bandpass filter 10. When the bandpass filter 10 is mounted on a printed circuit board, the metal plate 13 of the bandpass filter 10 is directly connected to the ground electrode formed on the printed circuit board by solder or the likes and the exciting electrodes 14 and 15 of the bandpass filter 10 are directly connected to the input/output electrodes formed on the printed circuit board by solder or the like. That is, the bandpass filter 10 of this embodiment can be used as a SMD (Surface Mount Device). Thus, this embodiment makes the thickness of the bandpass filter 10 small and makes the area required for mounting the bandpass filter 10 correspondingly small.

In order to widen the bandwidth (passing bandwidth) of the bandpass filter 10, increasing the external circuit coupling (excitation coupling) is effective. The external circuit coupling capacitance C can be calculated using the following equation.

$$C = \frac{\varepsilon_0 \varepsilon_r A}{t} \tag{1}$$

Where, $\square_o$ is permittivity of the air, $\square_r$ is the relative permittivity of the material of the dielectric block 11, A is each of the surface area of the exciting electrodes 14 and 15, and t is the thickness of the dielectric block 11.

From equation (1), when the material of the dielectric block 11 is decided, the value of the external circuit coupling capacitance C can be increased by increasing the surface area A of the exciting electrodes 14 and 15 and/or decreasing the thickness t of the dielectric block 11.

However, the overall size of the bandpass filter 10 increases with increasing the surface area A. Therefore, in order to increase the external circuit coupling capacitance C, it is preferable to decrease the thickness t of the dielectric block 11. Decreasing the thickness t of the dielectric block 11 means decreasing the thickness of the bandpass filter 10.

According to this embodiment, a very thin (0.5 mm) dielectric block 11 is used and the exciting electrodes 11 end 15 are disposed, on the bottom surface of the dielectric block 11 taking the above-described into consideration. surface of the dielectric block 11 taking above described into consideration.

Figure 7:
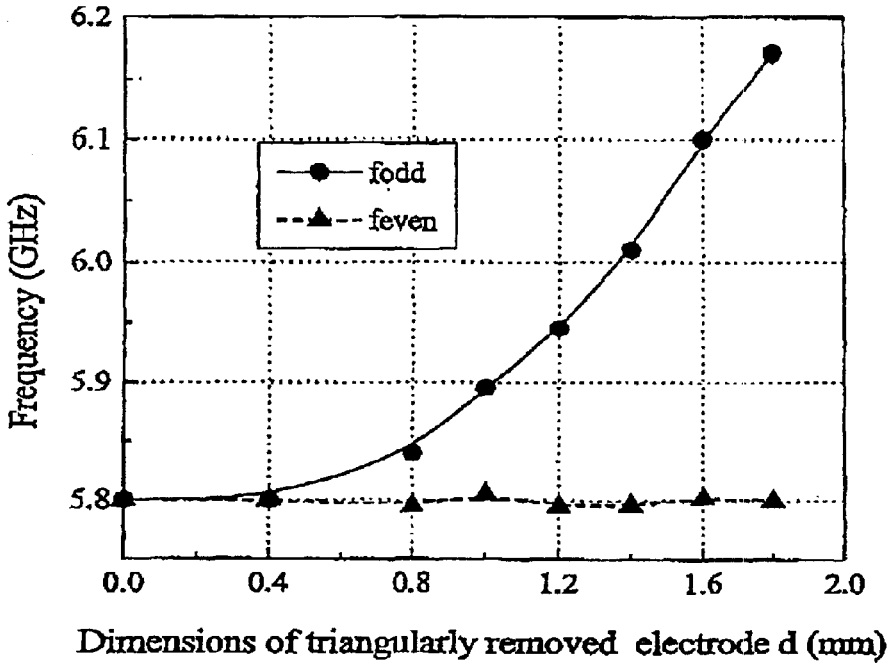
FIG. 7 is a graph showing the relationship between the length d of the edge of the removed portion 16 and an even mode resonant frequency $f_{even}$ and an odd mode resonant frequency $f_{odd}$.

FIG. 7 is a graph showing the relationship between the length d of the edge of the removed portion 16 and an even mode resonant frequency $f_{even}$ and an odd mode resonant frequency $f_{odd}$.

As shown in FIG. 7, the difference between the even mode resonant frequency $f_{even}$ and the odd mode resonant frequency $f_{odd}$ increases with increasing the length d of the edge of the removed portion 16, whereas the even mode resonant frequency $f_{even}$ and the odd mode resonant frequency $f_{odd}$ are the same when the length d is 0 mm, i.e., without the removed portion. This means that the symmetry of the resonator structure of each mode is affected by increasing the length d of the edge of the removed portion 16.

Further, although the even mode resonant frequency $f_{even}$ has very little dependence upon the length d of the edge of the removed portion 16, the odd mode resonant frequency $f_{odd}$ markedly increases when the length d is increased. This implies that the coupling between dual modes caused by the removed portion 16 is inductive.

The coupling constant k between the dual modes can be represented by the following equation.

$$k = \frac{f_{even}^2 - f_{odd}^2}{f_{even}^2 + f_{odd}^2} \tag{2}$$

The relationship between the length d of the edge of the removed portion 16 and the coupling constant k can be obtained by referring to the equation (2).

Figure 8:
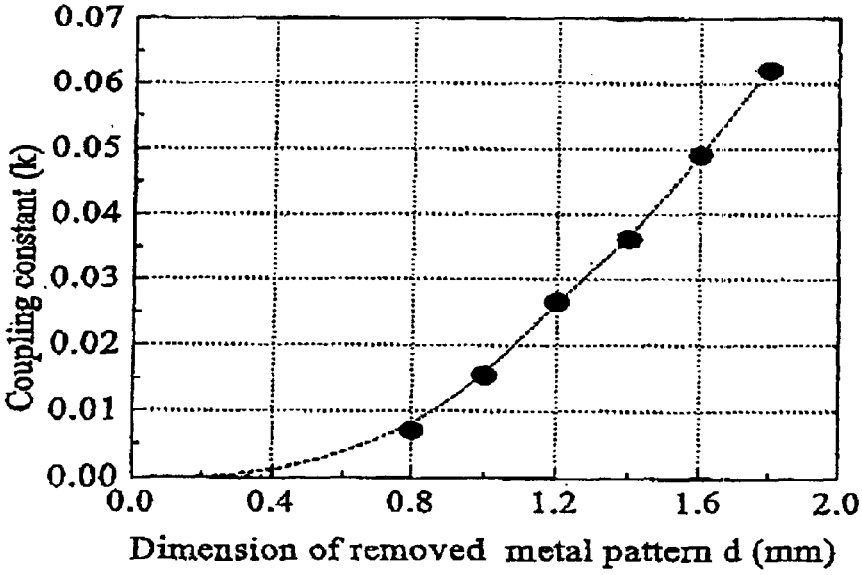
FIG. 8 is a graph showing the relationship between the length d of the edge of the removed portion 16 and a coupling constant k.

FIG. 8 is a graph showing the relationship between the length d of the edge of the removed portion 16 and a coupling constant k.

As is apparent from FIG. 8, the coupling constant k exponentially increases with increasing length d of the edge of the removed portion 16, whereas the coupling constant k is zero when the length d is 0 mm, i.e., without any removed portion. Thus, a desired coupling constant k can be obtained by controlling the length d of the edge of the removed portion 16. In order to obtain a coupling constant k of 0.036, the length d of the edge of the removed portion 16 should be 1.41 mm. In this case, an external quality factor becomes about 27.

Figure 9:
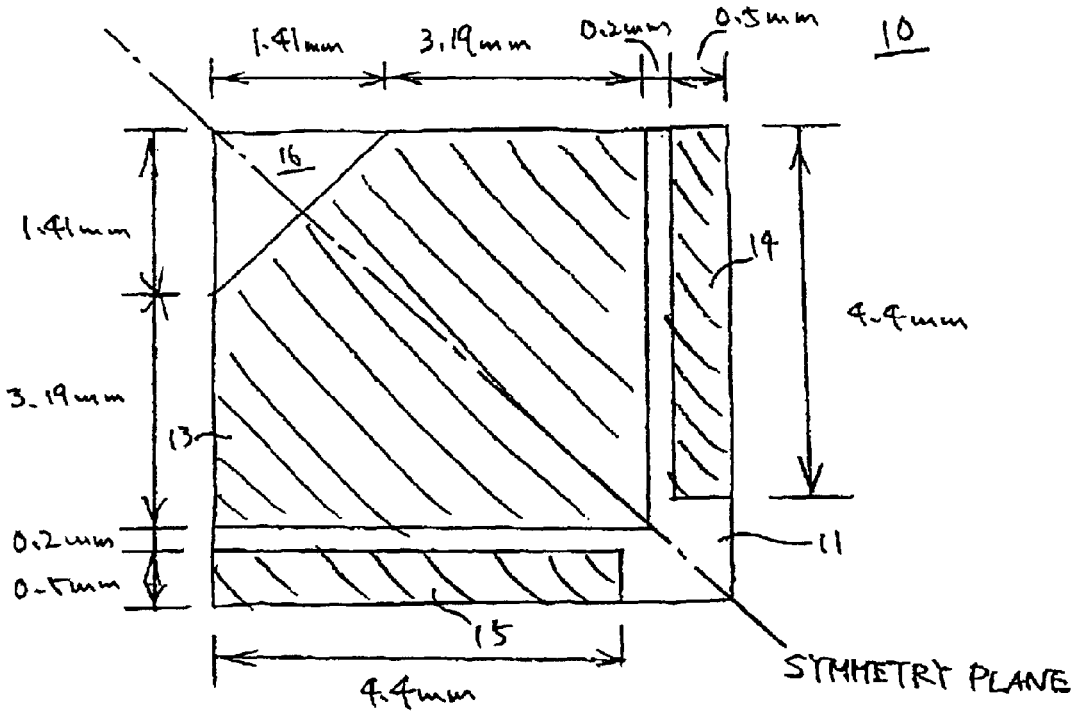
FIG. 9 is a schematic plan view from bottom side showing the bandpass filter 10 where the length d of the edge of the removed portion 16 is 1.41 mm.
Figure 10:
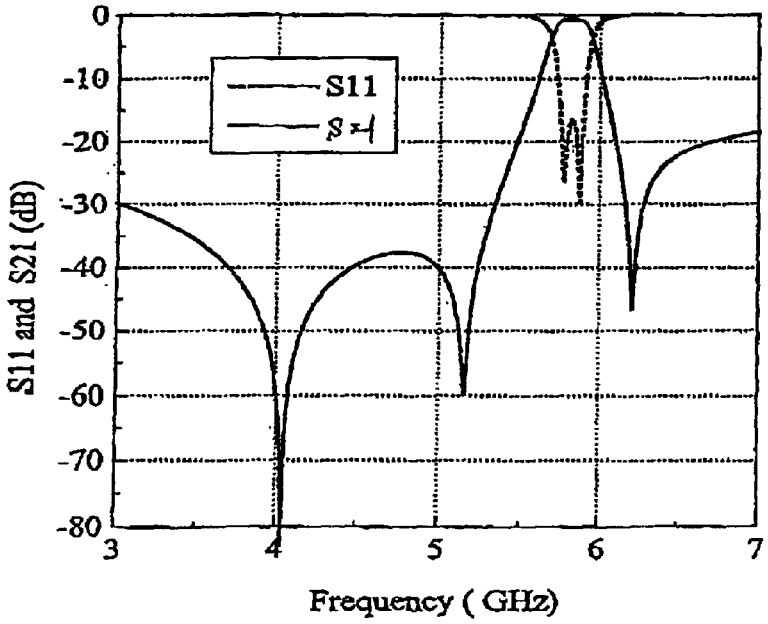
FIG. 10 is graph showing the frequency characteristic curve of the bandpass filter 10 shown in FIG. 9.

FIG. 9 is a schematic plan view from a bottom side showing the bandpass filter 10 where the length d of the edge of the removed portion 16 is 1.41 mm. FIG. 10 is a graph showing the frequency characteristic curve of the bandpass filter 10 shown in FIG. 9.

In FIG. 10, S11 represents a reflection coefficient, and S21 represents a transmission coefficient. As shown in FIG. 10, the center resonant frequency of the bandpass filter 10 shown in FIG. 9 is approximately 5.8 GHz and its 3-dB bandwidth is approximately 280 MHz. According to the bandpass filter 10 of this embodiment, a very wide bandwidth can be obtained. Further, attenuation poles appear at approximately 4.1 GHz and 5.2 Gllz in the lower side of the passing band and an attenuation pole appears at approximately 6.3 GHz in higher side of the passing band. Therefore, both of the lower and higher edges of the passing band of the frequency characteristics are sharpened.

Because, as described above, in the bandpass filter 10 according to this embodiment, the exciting electrodes 14 and 15 are formed on the bottom surface of the dielectric block 11, the bandpass filter 10 can be directly mounted on the printed circuit board without using any wires.

That is, the bandpass filter 10 can be used as a SMD so that the area required for mounting can be reduced. Therefore, in the bandpass filter 10 according to this embodiment, a very thin shape and broadband operation can be achieved simultaneously.

Further, according to the bandpass filter 10 of the present invention, because the metal plate 12 is formed on the top surface of the dielectric block 11 and the thickness of the dielectric block II is small, the radiation loss can be reduced. T herefore, a high unloaded quality factor ($Q_0$) can be obtained.

Moreover, according to the bandpass filter 10, because the attenuation poles appear at both the higher side and the lower side, a sharp frequency characteristic can be obtained.

In this embodiment, although the removed portion 16 is positioned at the corner 11*ab* of the edge 11*a* and 11*b*, the removed portion 16 can be positioned at another portion.

Figure 11:
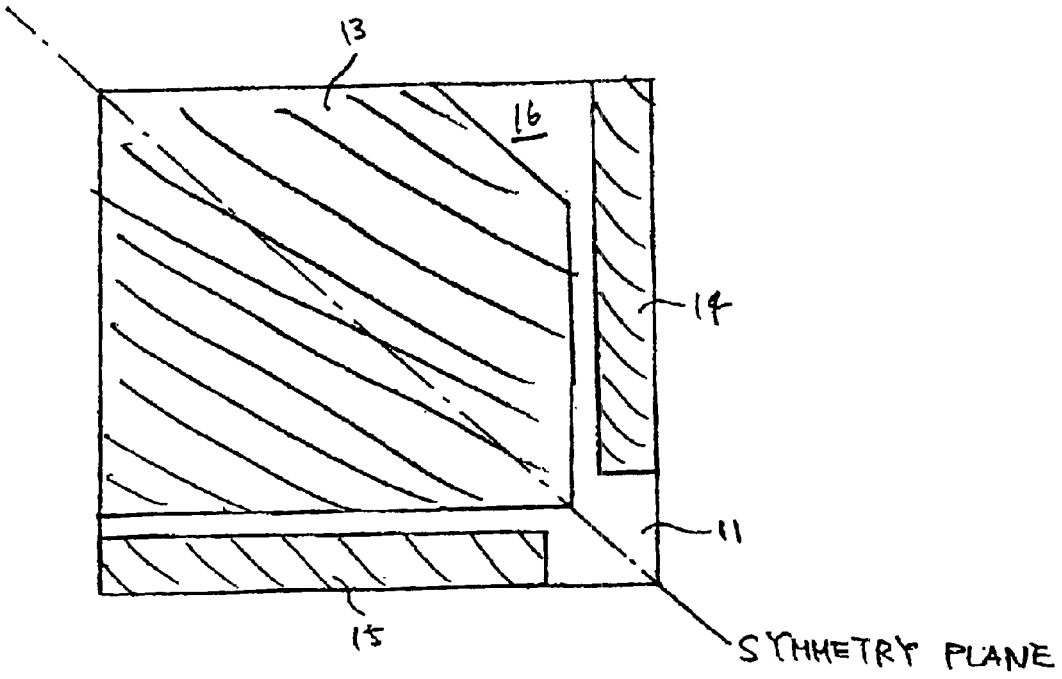
FIG. 11 is a schematic plan view showing an exemplary embodiment in which the removed portion 16 is positioned at the upper right of the metal plate 13.
Figure 12:
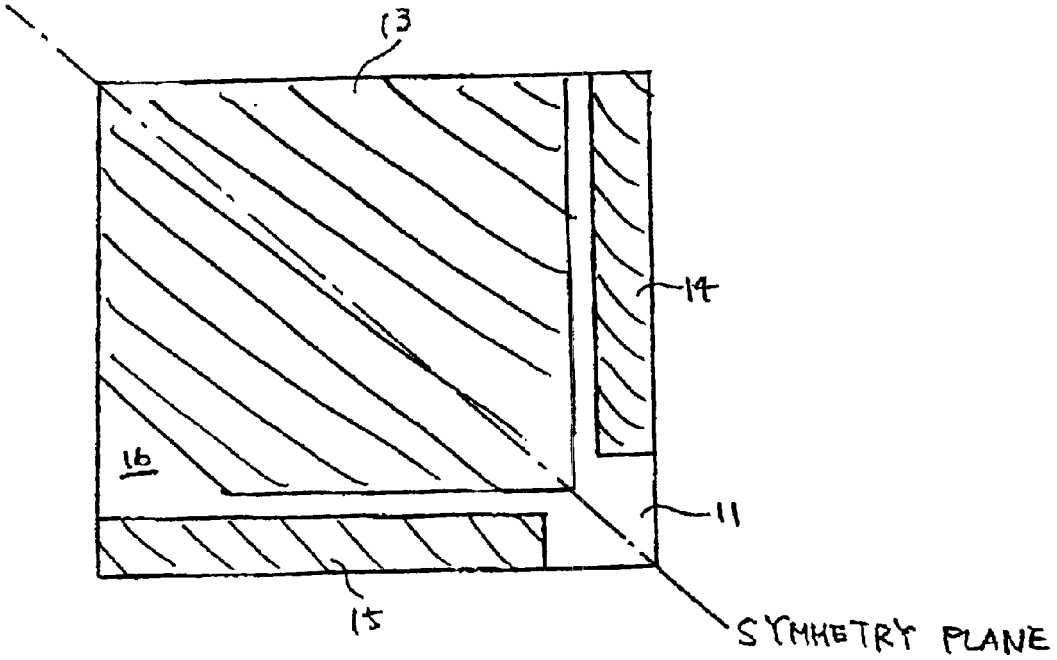
FIG. 12 is a schematic plan view showing an exemplary embodiment in which the removed portion 16 is positioned at the lower left of the metal plate 13.
Figure 13:
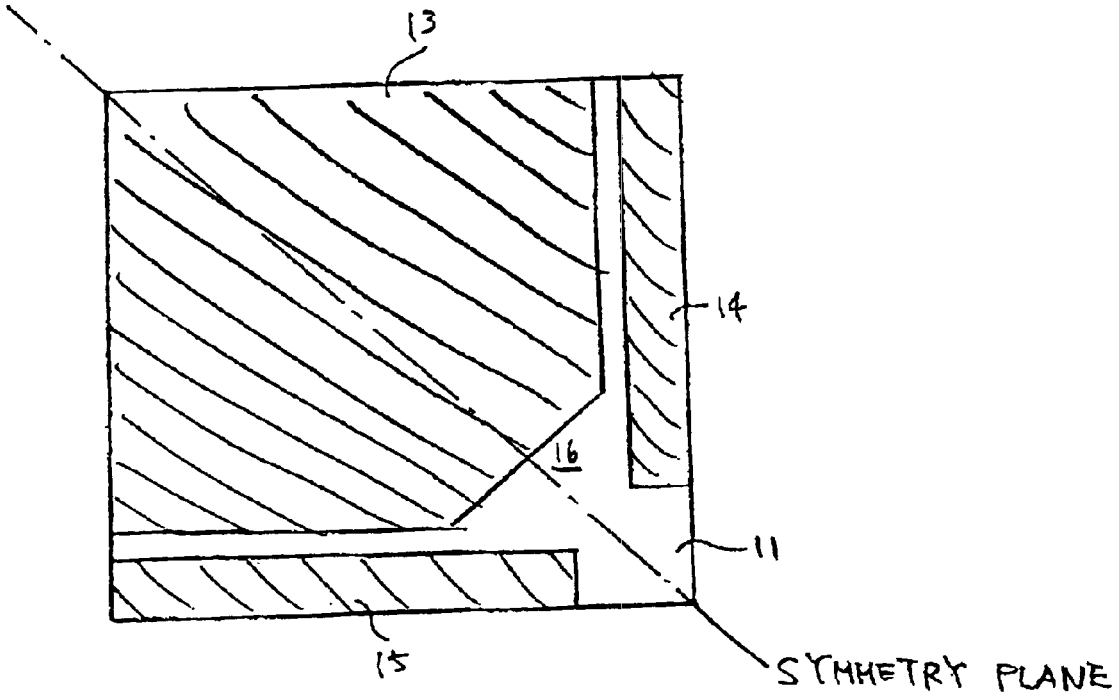
FIG. 13 is a schematic plan view showing an exemplary embodiment in which the removed portion 16 is positioned at the lower right of the metal plate 13.

FIGS. 11 to 13 are schematic plan views showing an exemplary embodiment wherein the removed portion 16 is positioned at another corner. The removed portion 16 is positioned at the upper right of the metal plate 13 in FIG. 11, at the lower left of the metal plate 13 in FIG. 12, and at the lower right of the metal plate 13 in FIG. 13. The coupling between the dual modes is also provided in the exemplary embodiments of FIGS. 11 to 13 because the syxnnietzy of the resonator structure of each mode is destroyed by the removed portion 16.

Further, in these embodiments, although the removed portion 16 is triangular, the removed portion 16 can be another shape where by the symmetry of the resonator structure of each mode is destroyed.

Figure 14:
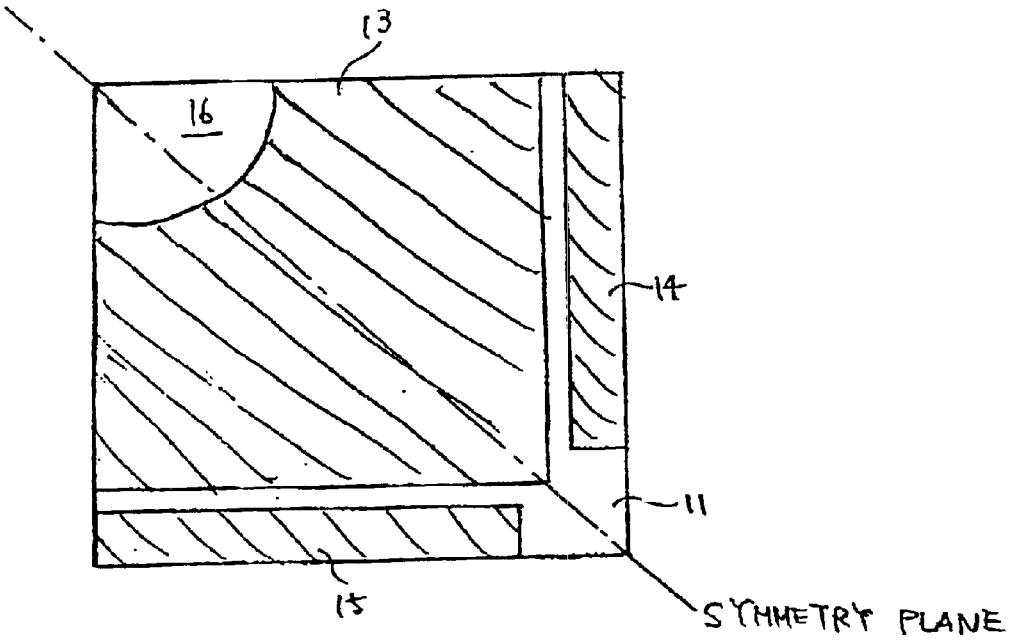
FIG. 14 is a schematic plan view showing an exemplary embodiment in which the removed portion 16 is in the form of a sector.
Figure 15:
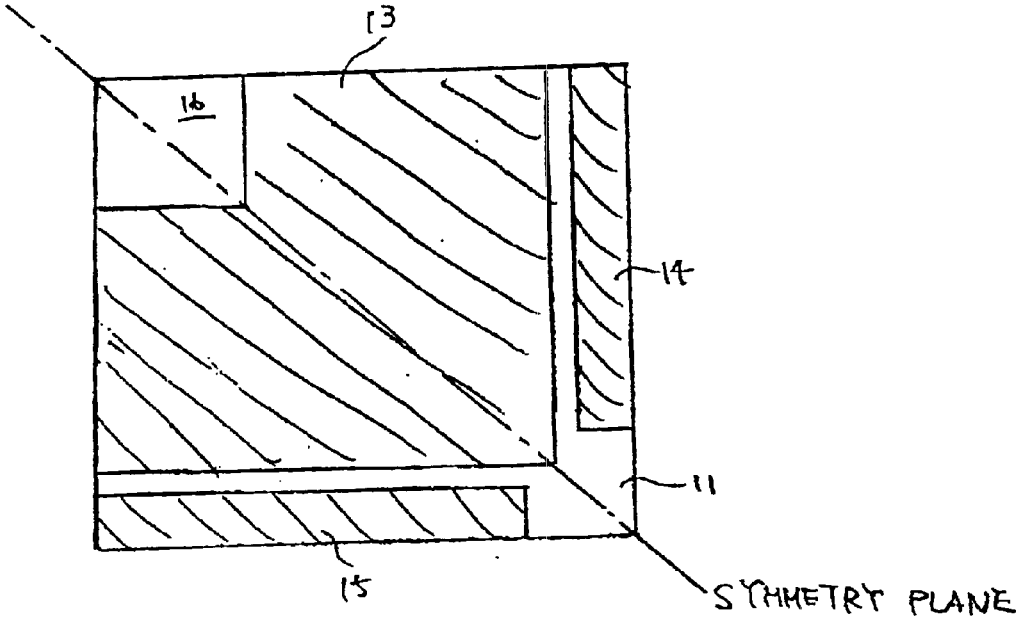
FIG. 15 is a schematic plan view showing an exemplary embodiment in which the removed portion 16 is a rectangular.

FIGS. 14 and 15 are schematic plan views showing an exemplary embodiment of the present invention inventory in which the removed portion 16 has another shape. In FIG. 14, the removed portion 16 is a sector; in FIG. 15, the removed portion 16 is rectangular. The coupling between the dual modes is also provided in the examples shown in FIGS. 14 and 15, because the symmetry of the resonator structure of each mode is destroyed by the removed portion 16.

Moreover, in these embodiments, although the removed portion 16 is positioned at the corner of the metal plate 13, the removed portion 16 can be positioned at another portion whereby the symmetry of the resonator structure of each mode is destroyed.

Figure 16:
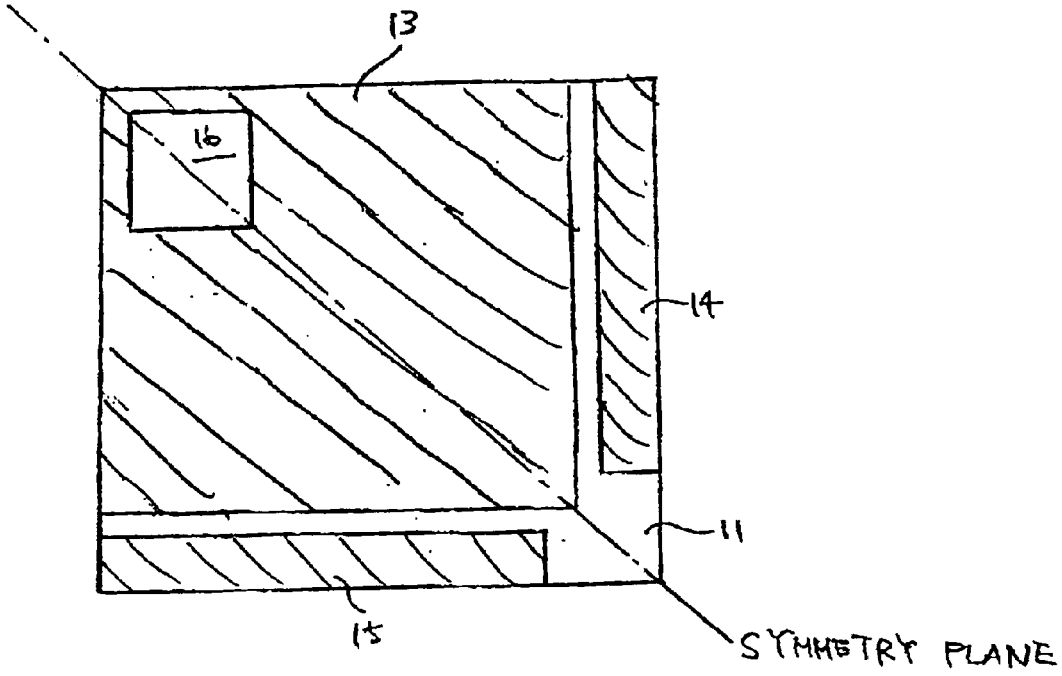
FIG. 16 is a schematic plan view showing an exemplary embodiment in which the removed rectangular portion 16 is positioned at an inner location of the metal plate 13.
Figure 17:
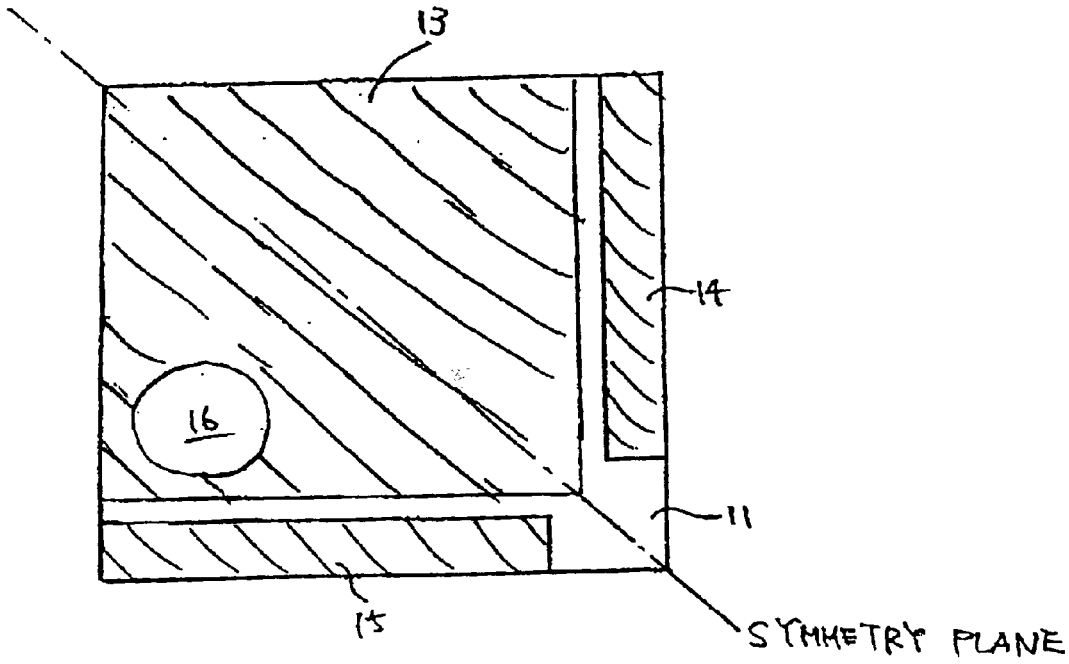
FIG. 17 is a schematic plan view showing an exemplary embodiment in which the removed portion 16 is circular and is positioned at an inner location of the metal plate 13.

FIGS. 16 and 17 are schematic plan views showing an exemplary embodiment of the present invention in which the removed portion 16 is positioned at an inner location of the metal plate 13. In FIG. 16, the rectangular removed portion 16 is positioned at an inner location of the metal plate 13 close to the upper left corner, in FIG. 17, the circular removed portion 16 is positioned at an inner location of the metal plate 13 close to the lower left corner. The coupling between the dual modes is also provided in the examples shown in FIGS. 16 and 17, because the symmetry of the resonator structure of each mode is destroyed by the removed portion 16.

Furthermore, in this embodiment, although only one removed portion 16 is formed, the number of removed portion 16 can be a plurality of removed portions whereby the symmetry of the resonator structure of each mode is destroyed.

Figure 18:
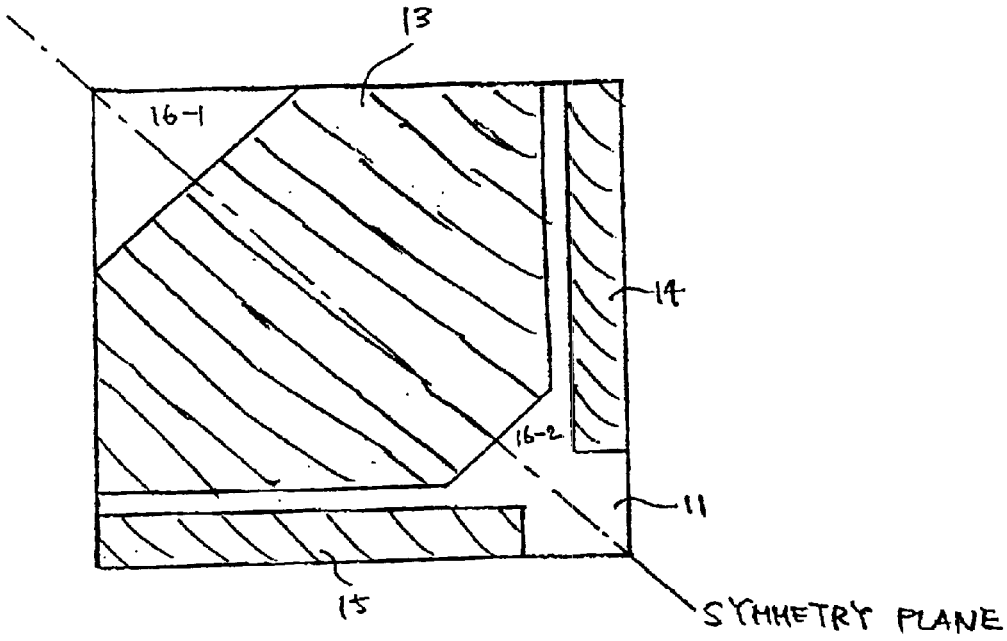
FIG. 18 is a schematic plan view showing an exemplary embodiment in which two removed portions 16 are employed.
Figure 19:
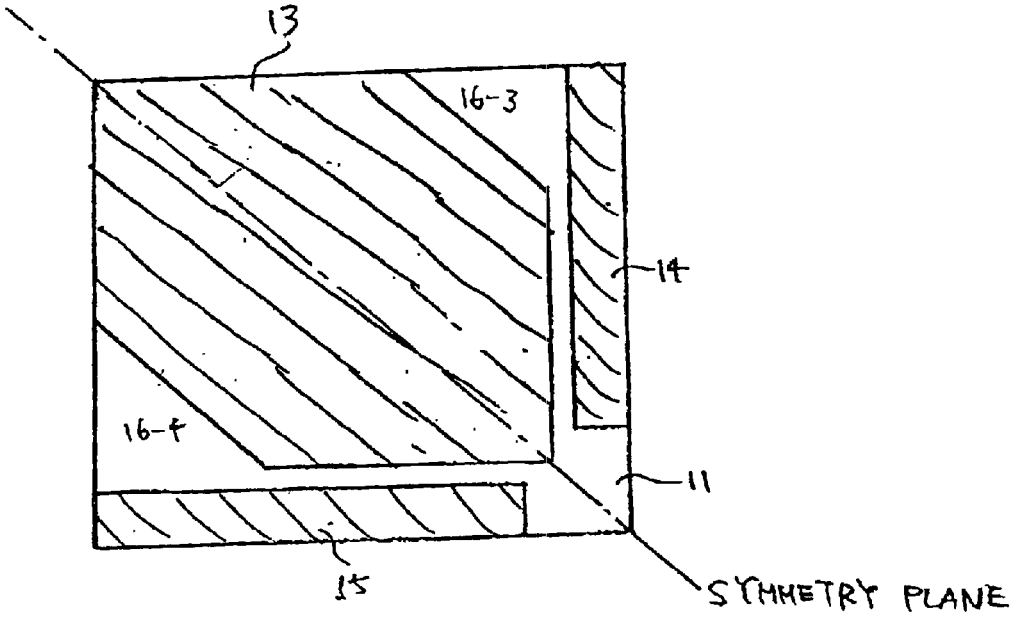
FIG. 19 is a schematic plan view showing another exemplary embodiment in which two removed portions 16 are employed.

FIGS. 18 and 19 are schematic plan views showing the an exemplary embodiment of the present invention in which a plurality of removed portions 16 are formed on the metal plate 13.

In FIG. 18, two rectangular removed portions 16-1 and 16-2 are positioned at the upper left corner and the lower right corner, respectively; in FIG. 19, two rectangular removed portions 16-3 and 16-4 are positioned at the upper right and lower left corner, respectively. The inductive coupling and capacitive coupling between the dual modes is also provided in the examples shown in FIGS. 18 and 19, respectively, because the symmetry of the resonator structure of each mode is destroyed by the removed portions 16-1 to 16-4.

Another preferred embodiment of the present invention will now be explained.

Figure 20:
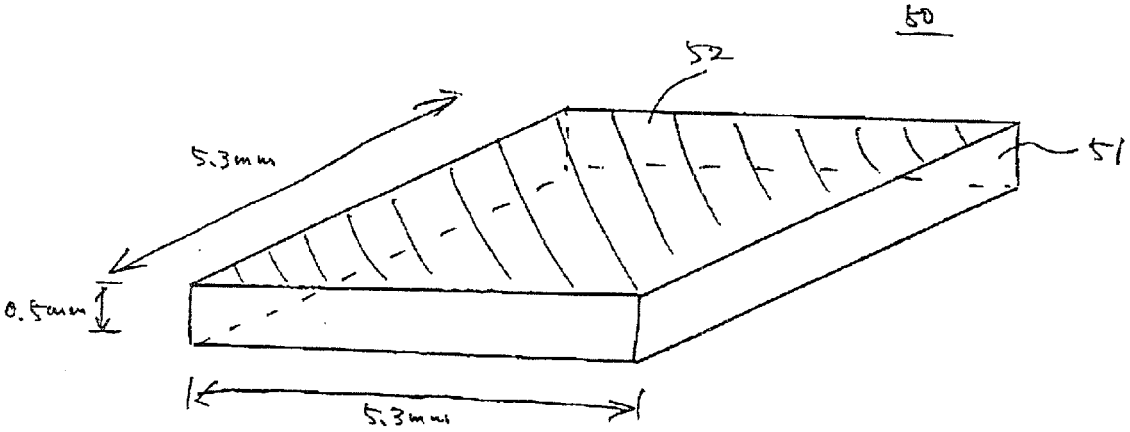
FIG. 20 is a schematic perspective view from a top side showing a bandpass filter 50 that is another preferred embodiment of the present invention.
Figure 21:
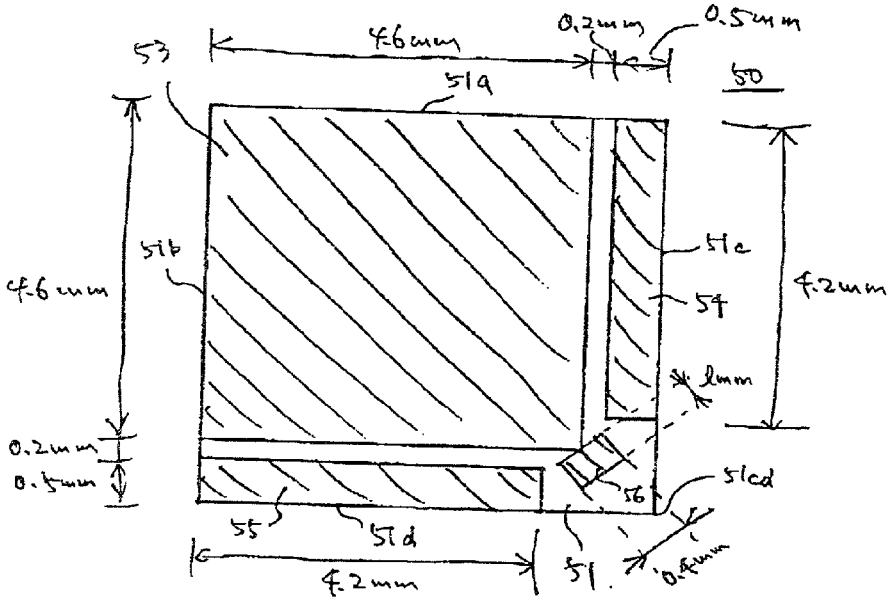
FIG. 21 is a schematic plan view from a bottom side showing the bandpass filter 50.

FIG. 20 is a schematic perspective view from a top side showing a bandpass filter 50 that is another preferred embodiment of the present invention. FIG. 21 is a schematic plan view from a bottom side showing the bandpass filter 50.

As shown in FIGS. 20 and 21, the bandpass filter 50 that is another preferred embodiment of the present invention is constituted of a dielectric block 51 and various metal plates formed on the surface thereof. The dielectric block 51 corresponds to the dielectric block 11 used in the bandpass filter 10 of above-described embodiment. Thus, the dielectric block 51 is made of dielectric material whose dielectric constant, $\square_r$=33, and has the shape of a rectangular prism whose length, width, and thickness are 5.3 mm, 5.3 mm and 0.5 mm, respectively.

A metal plate 52 is formed on the top surface of the dielectric block 51. A metal place 53, exciting electrodes 54 and 55, and a coupling control stub 56 are formed on the bottom surface of the dielectric block 51. As shown in FIG. 21, the dimension of the metal plate 53 is 4.6 mm×4.6 mm square along the edge 51*a* and the edge 51*b* adjacent to the edge 51*a* of the bottom surface of the dielectric block 51. No removed portion is formed on the metal plate 53 different from the bandpass filter 10. The exciting electrode 54 is located along the edge 51*a* and the edge 51*c* opposite to the edge 51*b* and the dimension of the exciting electrode 54 are 0.5 mm ×4.2 mm rectangular. The exciting electrode 55 is located along the edge 51*b* and the edge 51*d* opposite to the edge 51*a* and the dimensions of the exciting electrode 55 measures 0.5 mm×4.2 m rectangular.

The coupling control stub 56 is located adjacent the corner 51*cd* of the edge 51*c* and edge 51*d*, being in contact with the metal plate 53. The dimensions of the coupling control stub 56 measures 0.4 mm×1 rectangular.

The metal plate 53 and the exciting electrode 54 are prevented from contacting each other by a 0.2 mm gap. Similarly, the metal plate 53 and the exciting electrode 55 are prevented from contacting each other by a 0.2 mm gap. No metal plate or electrode is formed on the remaining surfaces of the dielectric block 51, which therefore constitute open ends.

In actual use, the metal plate 52 formed on the top surface of the dielectric block 51 is floating and the metal plate 53 formed on the bottom surface of the dielectric block 51 is grounded similar to the bandpass filter 10. One of the exciting electrodes 54 and 55 is used as an input electrode, and the other is used as an output electrode.

According to the above described structure, although the bandpass filter 50 of this preferred embodiment acts as a TEM dual-mode rectangular-planar dielectric waveguide bandpass filter, the symmetry of the resonator structure of each mode is destroyed by the coupling control stub 56. In other words, the coupling control stub 56 gives coupling between the dual modes The coupling between the dual modes increases with increasing the area of the coupling control stub 56, because the magnitude of the destruction of symmetry increases as the area of the coupling control stub 56 increases.

Figure 22:
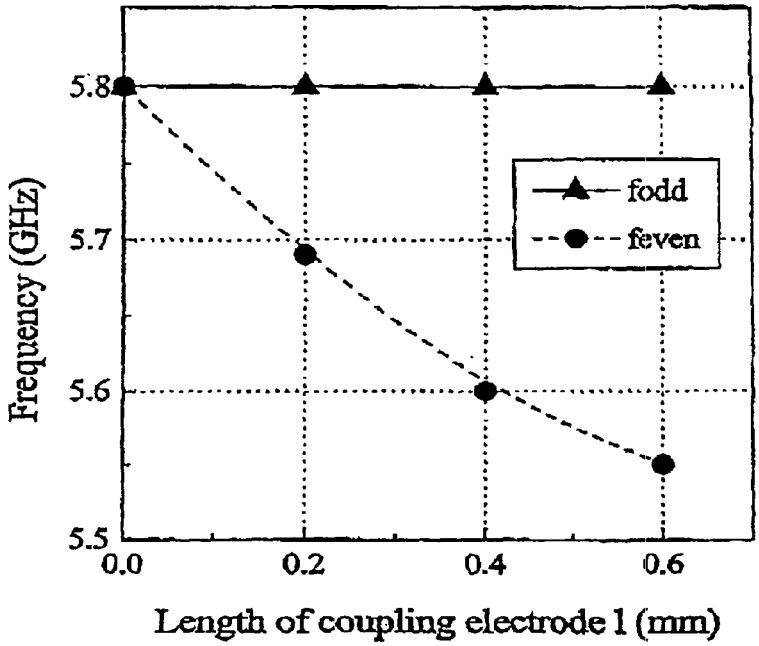
FIG. 22 is a graph showing the relationship between the length l of the edge of the coupling control stub 56 and an even mode resonant frequency $f_{even}$ and an odd mode resonant frequency $f_{odd}$.

FIG. 22 is a graph showing the relationship between the length l of the edge of the coupling control stub 56 and an even mode resonant frequency $f_{even}$ and an odd mode resonant frequency $f_{odd}$.

As shown in FIG. 22, the difference between the even mode resonant frequency $f_{even}$ and the odd mode resonant frequency $f_{odd}$ increases as the length l of the coupling control stub 56 increases, whereas the even mode resonant frequency $f_{even}$ and the odd mode resonant frequency $f_{odd}$ are the same when the length l is 0 mm, i.e., without the coupling control stub. This means that the symmetry of the resonator structure of each mode is affected by increasing the length l of the coupling control stub 56.

Further, although the odd mode resonant frequency $f_{odd}$ has very little dependence upon the length l of the coupling control stub 56, the even mode resonant frequency $f_{even}$ markedly decreases as the length l increases. This implies that the coupling between the dual modes caused by the coupling control stub 56 is capacitive.

The coupling constant k between the dual modes can be represented by the equation (2) described earlier.

Figure 23:
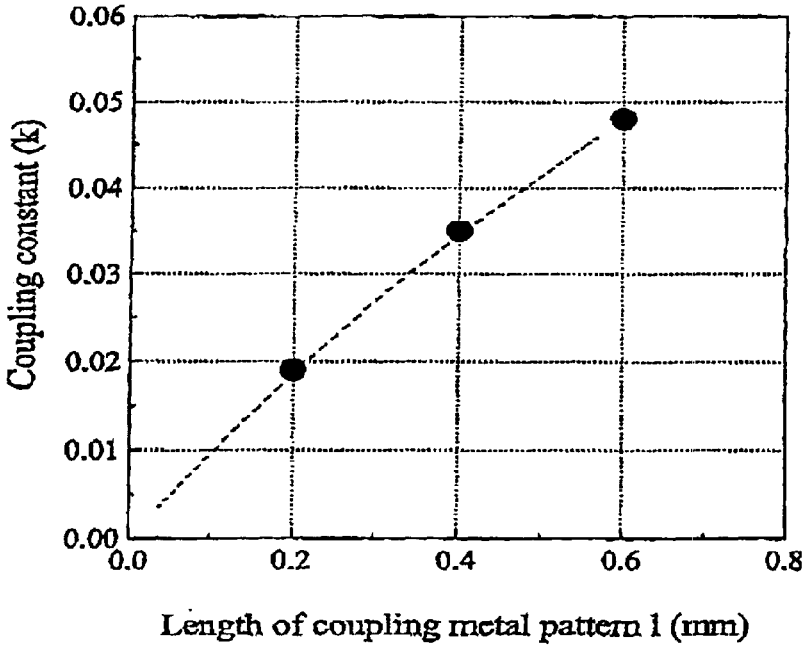
FIG. 23 is a graph showing the relationship between the length l of the edge of the coupling control stub 56 and a coupling constant k.

FIG. 23 is a graph showing the relationship between the length l of the coupling control stub 56 and a coupling constant k.

As is apparent from FIG. 23, the coupling constant k linearly increases with increasing length 1 of the coupling control stub 56, whereas the coupling constant k is zero when the length 1 is 0 mm, i.e., without coupling control stub. Thus, a desired coupling constant k can be obtained by controlling the length 1 of the coupling control stub 56. In order to obtain a coupling constant k being of 0.032, the length 1 of the coupling control stub 56 should be 0.36 mm.

Figure 24:
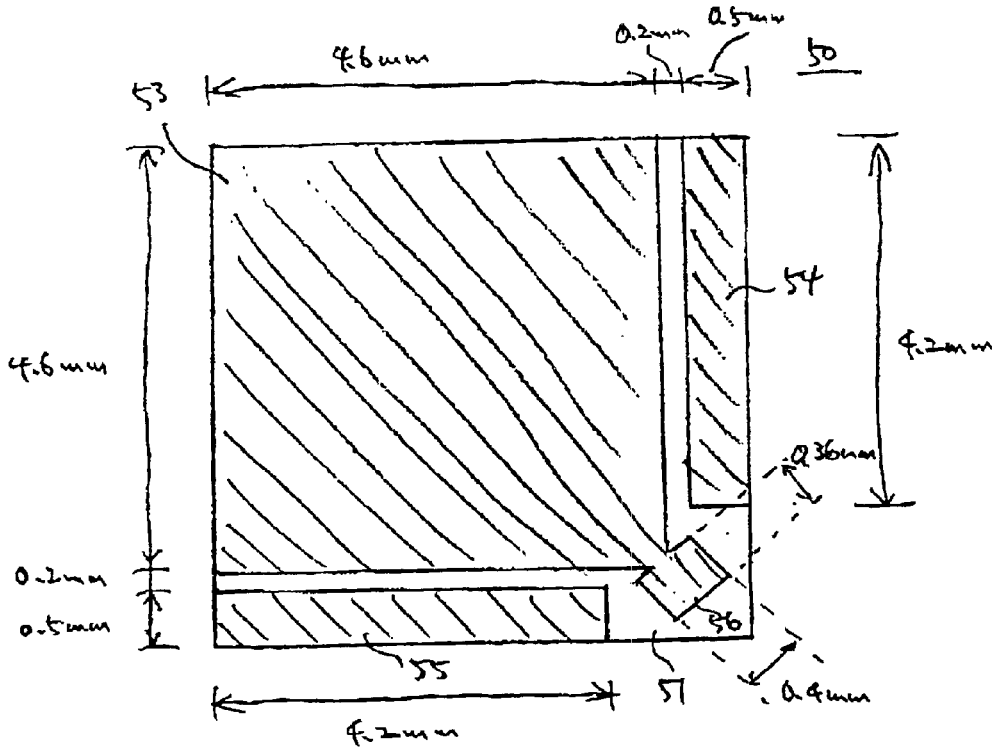
FIG. 24 is a schematic plan view from a bottom side showing the bandpass filter 50, where the length l of the edge of the coupling control stub 56 is 0.36 mm.
Figure 25:
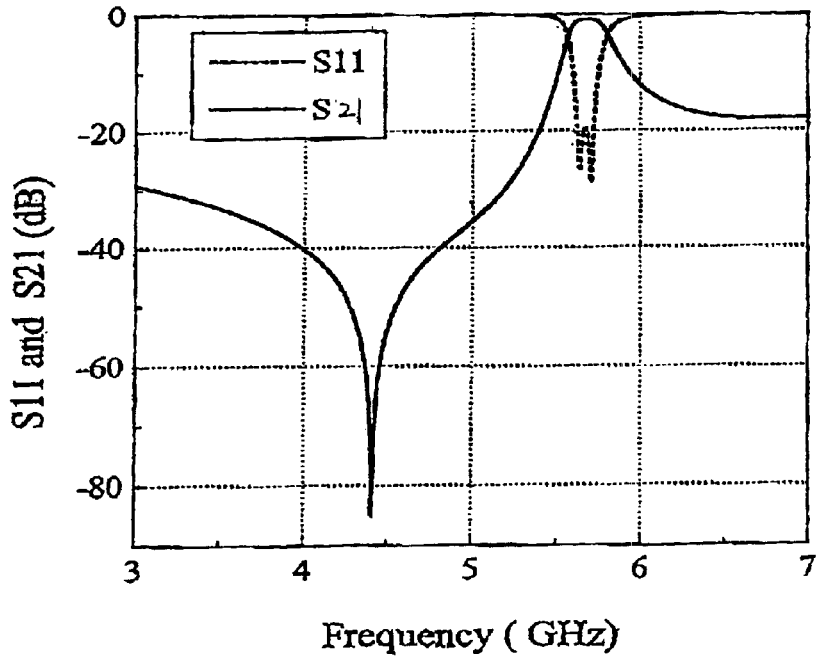
FIG. 25 is a graph showing the frequency characteristic curve of the bandpass filter 50 shown in FIG. 24.

FIG. 24 is a schematic plan view from a bottom side showing the bandpass filter 50, where the length 1 of the edge of the coupling control stub 56 is 0.36 mm. FIG. 25 is a graph showing the frequency characteristic curve of the bandpass filter 50 shown in FIG. 24.

In FIG. 25, S11 represents a reflection coefficient, and S21 represents a transmission coefficient. As shown in FIG. 25, the center resonant frequency of the bandpass filter 50 shown in FIG. 24 is approximately 5.66 Ghz and its 3-dB bandwidth is approximately 250 MHz. Thus, according to the bandpass filter 50 of this embodiment, a very wide bandwidth can be obtained. Further an attenuation pole appears at approximately 4.4 GHz1 so that the lower edge of the passing band of the frequency characteristics is sharpened.

The bandpass filer 50 has the effect that the radiation loss is more effectively reduced.

In this embodiment, although the coupling control stub 56 is rectangular, the coupling control stub 56 can be another shape whereby the symmetry or the resonator structure of each mode is destroyed.

Figure 26:
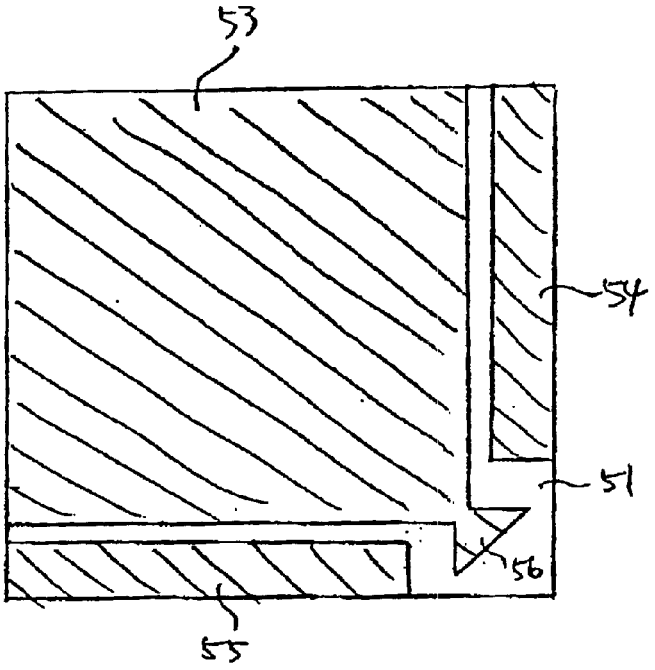
FIG. 26 is a schematic plan view showing an exemplary embodiment in which the coupling control stub 56 is triangular.
Figure 27:
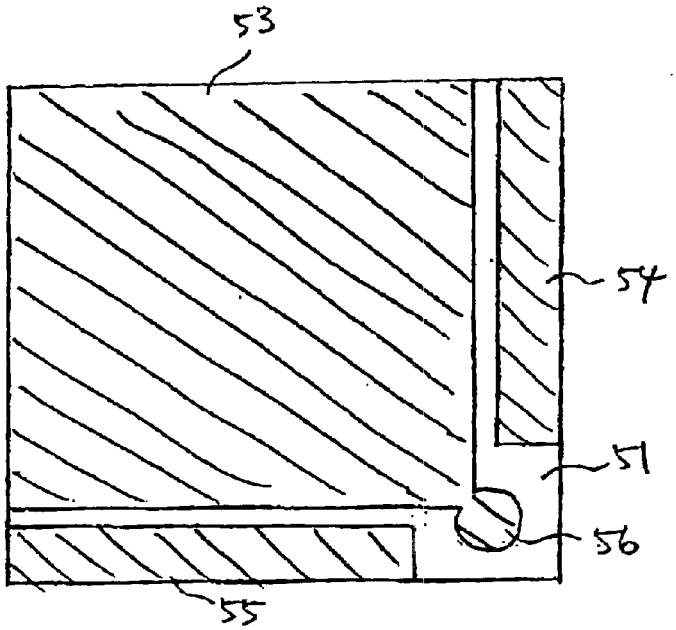
FIG. 27 is a schematic plan view showing an exemplary embodiment in which the coupling control stub 56 is circular.

FIGS. 26 and 27 are schematic plan views showing an exemplary embodiment of the present invention wherein the coupling control stub 56 has another shape. In FIG. 26, the coupling control stub 56 is triangular; in FIG. 27, the coupling control stub 56 is circular. The coupling between the dual modes is also provided in the example shown in FIGS. 26 and 27 because the symmetry of the resonator structure of each mode is affected by the coupling control stub 56.

Further, in these embodiments, although the symmetry of the resonator structure of each mode is destroyed by only using the coupling control stub 56, the removed portion 16 shown in FIGS. 9 and 11 to 19 can be employed in addition.

Figure 28:
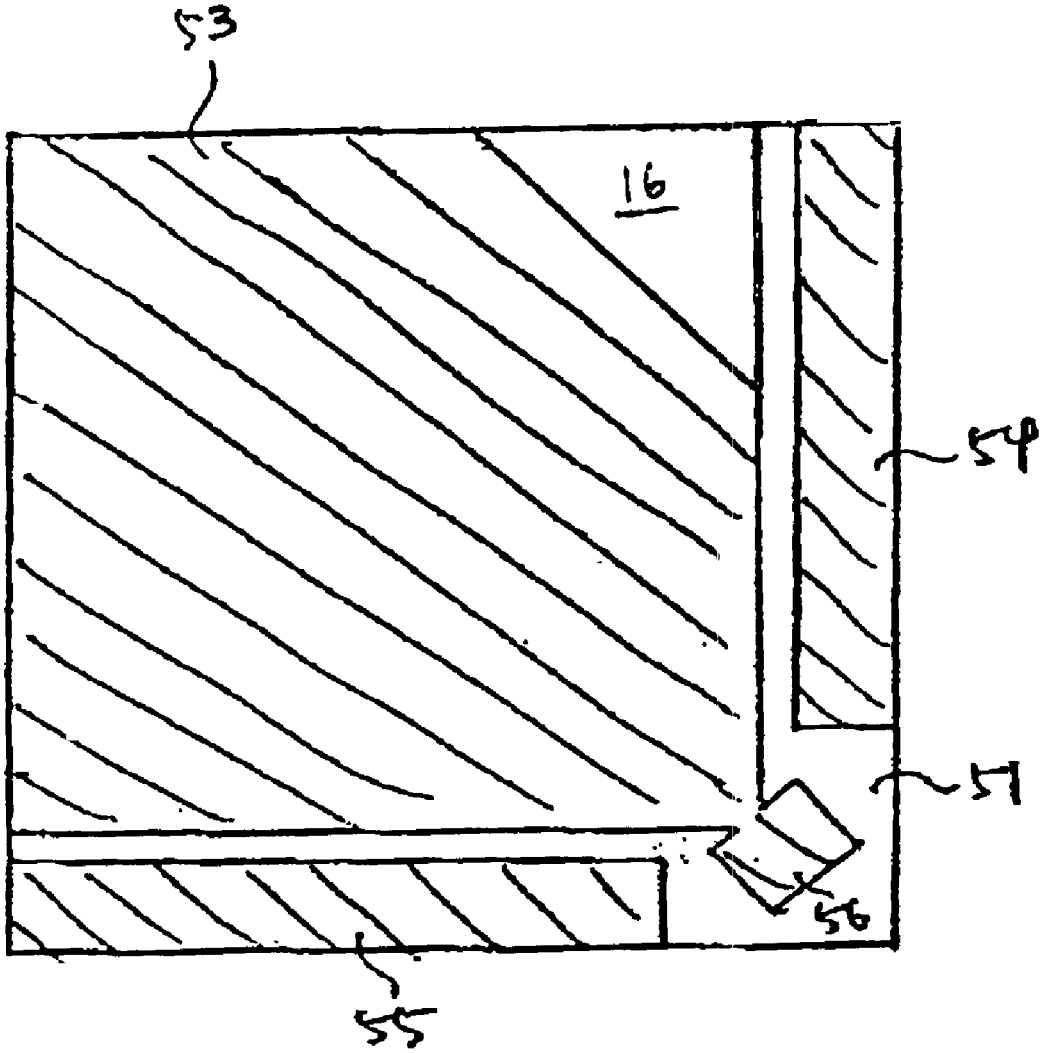
FIG. 28 is a schematic plan view showing an exemplary embodiment in which both a coupling control stub 56 and removed portions 16 are employed.

FIG. 28 is a schematic plan view showing an exemplary embodiment of the present invention wherein both a coupling control stub 56 and removed portions 16 are employed. In the example shown in FIG. 28, the rectangular coupling control stub 56 is formed and the triangular removed portions 16 are formed at the upper right comer of the metal plate 53. The capacitive coupling between the dual modes is also provided in the exemplary embodiment shown in FIG. 28, because the symmetry of the resonator structure of each mode is affected by the coupling control stub 56 and the removed portions 16.

A further preferred embodiment of the present invention will now be described.

Figure 29:
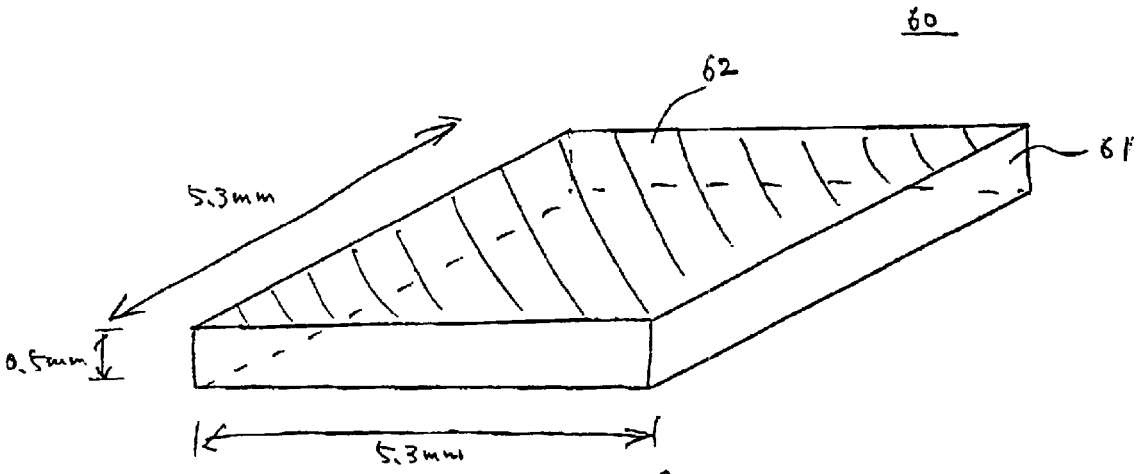
Figure 30:
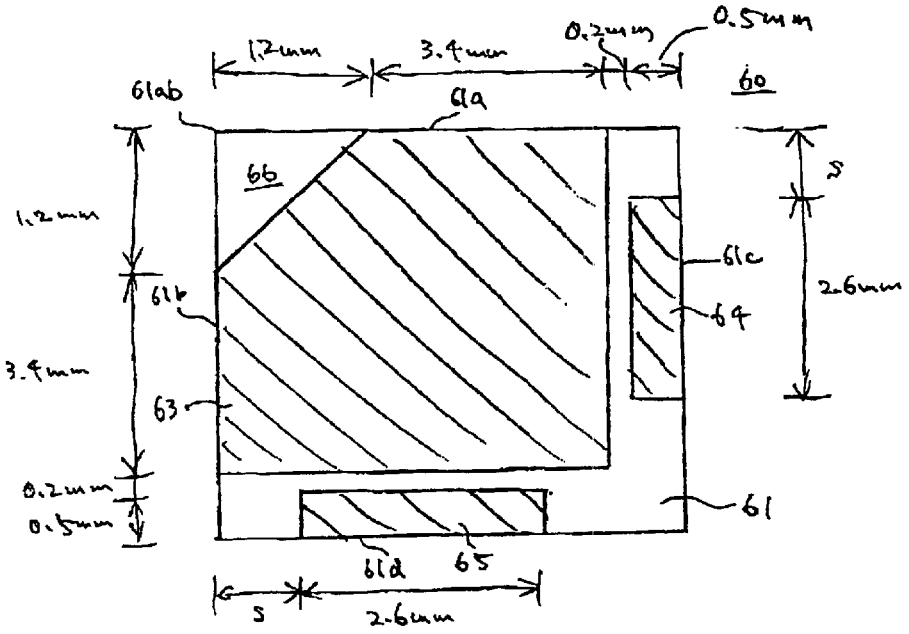
FIG. 30 is a schematic plan view from a bottom side showing the bandpass filter 60.

FIG. 29 is a schematic perspective view from a top side showing a bandpass filter 60 that is a further preferred embodiment of the present invention. FIG. 30 is a schematic plan view from a bottom side showing the bandpass filter 60.

As shown in FIGS. 29 and 30, the bandpass filter 60 that is a further preferred embodiment of the present invention is constituted of a dielectric block 61 and various metal plates formed on the surfaces thereof. The dielectric block 61 corresponds to the dielectric blocks 11 and 51 used in the bandpass filters 10 and 60 of above-described embodiments. Thus, the dielectric block 61 is made of a dielectric material whose dielectric constant, $\square_r$=33, and has the shape of a rectangular prism whose length, width, and thickness are 5.3 mm, 5.3 mm, and 0.5 mm. respectively.

A metal plate 62 is formed on the top surface of the dielectric block 61. A metal plate 63 and exciting electrodes 64 and 65 are formed on the bottom surface of the dielectric block 61. As shown in FIG. 30, the dimensions of the metal plate 63 are 4.6 mm×4.6 mm square along the edge 61*a*, and the edge 61*b* adjacent to the edge 61*a* of the bottom surface of the dielectric block 61 have a triangular removed portion 66 positioned at the corner 61*ab* formed by the edges 61*a* and 61*b* similar to the bandpass filter 10. As shown in FIG. 30, the exciting electrode 64 is located along the edge 61*c* opposite to the edge 61*b* and the dimensions of the exciting electrode 64 are 0.5 mm×2.6 mm rectangular. The exciting electrode 65 is located along the edge 61*d* opposite to the edge 61*a* and the dimensions of the exciting electrode 65 are 0.5 mm×2.6 mm rectangular. Further, the exciting electrode 64 is apart from the edge 61*a*, and the exciting electrode 65 is apart from the edge 61*b*, in contrast to the above described embodiments. As shown in FIG. 30, the distances between the exciting electrode 64 and the edge 61*a* and the exciting electrode 65 and the edge 61*b* are defined by clearances.

The metal plate 63 and the exciting electrode 64 are prevented from contacting each other by a 0.2 mm gap. Similarly, the metal plate 63 and the exciting electrode 65 are prevented from contacting each other by a 0.2 mm gap. No metal plate or electrode is formed on the remaining surfaces of the dielectric block 61 which, therefore, constitute open ends.

In actual use, the metal plate 62 formed on the top surface of the dielectric block 61 is floating and the metal plate 63 formed on the bottom surface of the dielectric block 61 is grounded, similar to the bandpass filter 10. One of the exciting electrodes 64 and 65 is used as an input electrode, and the other is used as an output electrode.

Figure 31:
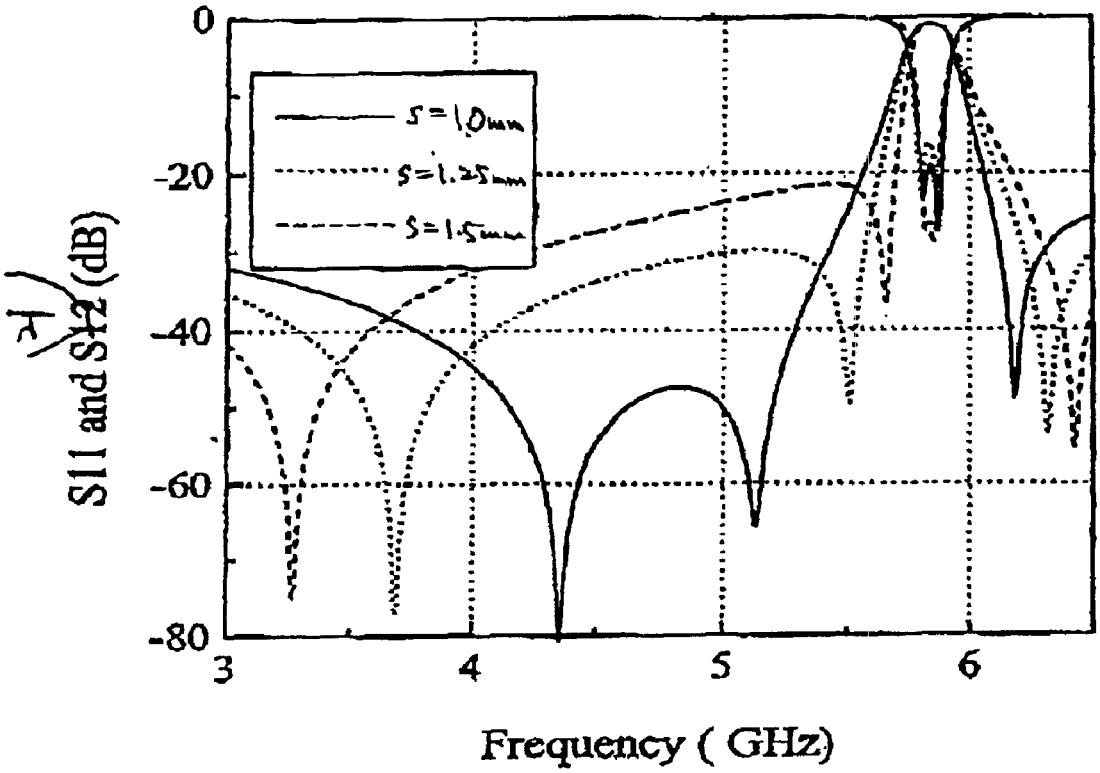
FIG. 31 is a graph showing the frequency characteristic curve of the bandpass filter 60 shown in FIGS. 29 and 30.

FIG. 31 is a graph showing the frequency characteristic curve of the bandpass filter 60 shown in FIGS. 29 and 30.

In FIG. 31, S11 represents a reflection coefficient, and S21 represents a transmission coefficient. As shown in FIG. 31, the frequencies of the attenuation poles drastically vary with changing clearance s, whereas the center resonant frequency of the bandpass filter 60 and its 3-dB bandwidth do not substantially vary with changing clearance s. Specifically, the frequencies of the attenuation poles shift high with increasing the clearance s, the frequencies of the attenuation poles shift low with decreasing the clearance s. Further, the attenuation level at the lower attenuation band decreases and the attenuation level at the higher attenuation band increases with increasing the clearance s, the attenuation level at the lower attenuation band increases and the attenuation level at the higher attenuation band decreases with decreasing the clearance s. This phenomenon is caused by the fact that a direct coupling between the exciting electrodes 64 and 65 increases with increasing the clearance s. Thus, the clearance s should be controlled based on a desired characteristic.

The bandpass filter 60 bas effects not only achievably by the bandpass filter 10 of the above-described embodiment but also an effect that the characteristics at the attenuation band can be controlled by the afore-described simple method.

In this embodiment, although the triangular removed portion 66 is formed on the upper left corner of the metal plate 63, the position, shape and number of the removed portion 66 are not limited to those of this as was explained with reference to FIGS. 11 to 19.

Further, in this embodiment, although the symmetry of the resonator structure of each mode is destroyed by using the removed portion 66, the symmetry also can be destroyed by using a coupling control stub similar to that discussed in connection with the bandpass filter 50 shown in FIGS. 20 and 21. A further preferred embodiment of the present invention will now be described.

Figure 32:
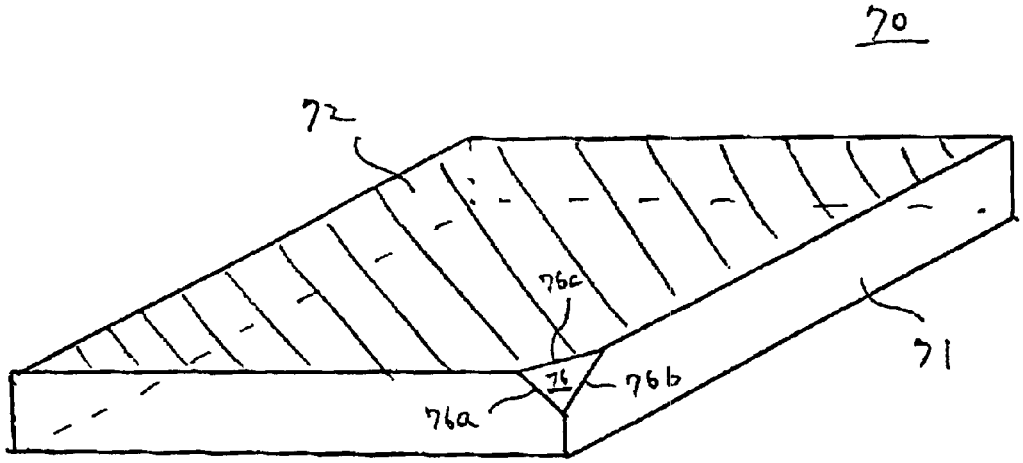
FIG. 32 is a schematic perspective view from a top side showing a bandpass filter 70 that is a further preferred embodiment of the present invention.
Figure 33:
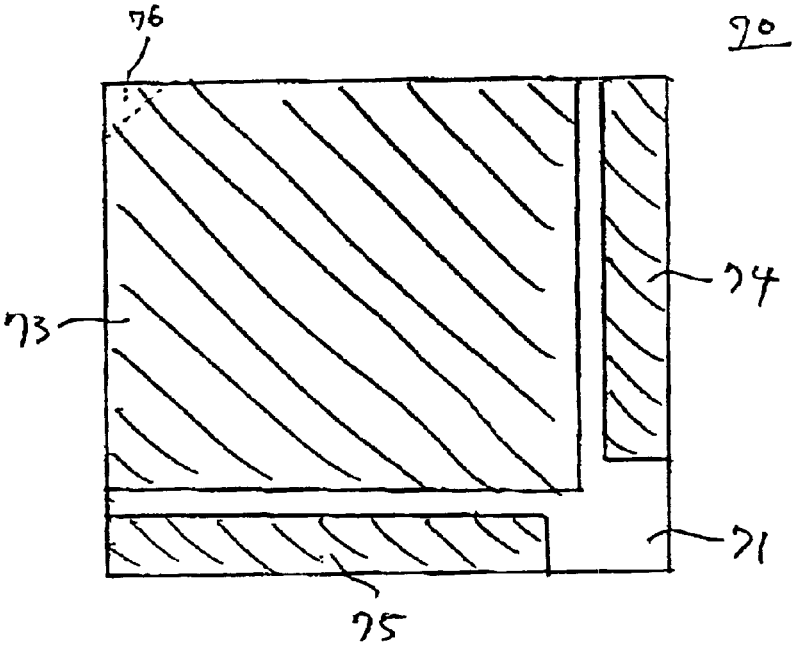
FIG. 33 is a schematic plan view from a bottom side showing a bandpass filter 70.

FIG. 32 is a schematic perspective view from a top side showing a bandpass filter 70 that is a further preferred embodiment of the present invention. FIG. 33 is a schematic plan view from a bottom side showing the bandpass filter 70.

As is shown in FIGS. 32 and 33, the bandpass filter 70 that is a further preferred embodiment of the present invention is constituted of a dielectric block 71 and various metal plates formed on the surface thereof. The dielectric block 71 corresponds to the dielectric blocks 11, 51, and 61 used in the bandpass filters 10, 50 and 60 of the above-described embodiments, except that the corner formed by the top surface and the adjacent two side surfaces thereof is removed. A rectangular surface 76 is formed at the removed corner. An edge 76*a* is formed on one side surface of the dielectric block 71 and an edge 76*b* is formed on the other side surface of the dielectric block 71, both of which have the same length.

A metal plate 72 is formed on the top surface of the dielectric block 71. A metal plate 73 and exciting electrodes 74 and 75 are formed on the bottom surface of the dielectric block 71. As shown in FIG. 33, no removed portion is formed on the metal plate 73.

In actual use, the metal plate 72 formed on the top surface of the dielectric block 71 is floating and the metal plate 73 formed on the bottom surface of the dielectric block 71 is grounded similar to the bandpass filter 10. One of the exciting electrodes 74 and 75 is used as an input electrode, and the other is used as an output electrode.

Because, as described above, in the bandpass filter 70 according to this embodiment, the corner of the dielectric block 71 is removed so as to destroy the symmetry of the resonator structure of each mode, effects similar to the above-described embodiments can be obtained. It is worth noting that the removed portion on the metal plate 73 and/or the coupling control stub optionally can be provided in this embodiment.

A further preferred embodiment of the present invention will now be described.

Figure 34:
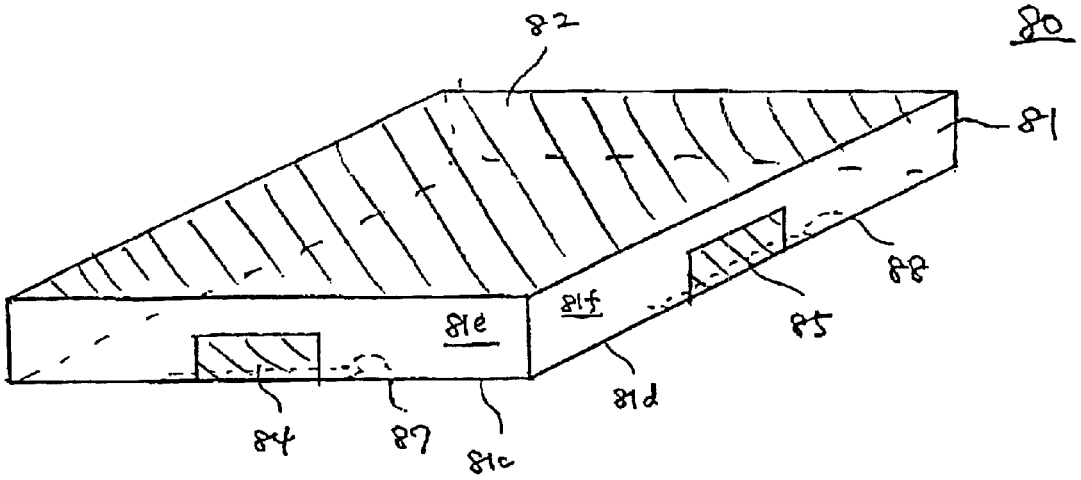
FIG. 34 is a schematic plan view from a top side showing a bandpass filter 80 that is a further preferred embodiment of the present invention.
Figure 35:
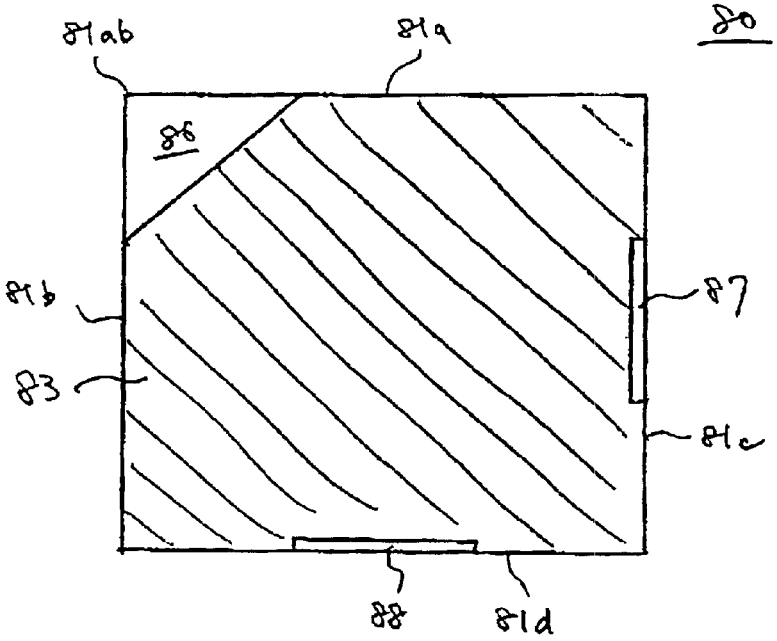
FIG. 35 is a schematic plan view from a bottom side showing a bandpass filter 80.

FIG. 34 is a schematic perspective view from top side showing a bandpass filter 80 that is a further preferred embodiment of the present invention. FIG. 35 is a schematic plan view from a bottom side showing the bandpass filter 80.

As shown in FIGS. 34 and 35, the bandpass filter 80 that is a further preferred embodiment of the present invention is constituted of a dielectric block 81 and various metal plates formed on the surface thereof. The dielectric block 81 corresponds to the dielectric blocks 11, 51, 61 used in the bandpass filters 10, 50 and 60. That is, the dielectric block 81 is a rectangular prism.

A metal plate 82 is formed on the entire top surface of the dielectric block 81. A metal plate 83 is formed on the entire bottom surface of the dielectric block 81 except at removed portions 86 to 88. As shown in FIG. 35, the removed portion 86 is positioned at the corner Slab formed by the edges 81*a* and 81*b* adjacent to the edge 81*a* of the bottom surface of the dielectric block 81; the removed portion 87 is positioned at the center of the edge 81*c* opposite to the edge 81*b* of the bottom surface of the dielectric block 81; and the removed portion 88 is positioned at the center of the edge 81*d* opposite to the edge 81*a* of the bottom surface of the dielectric block 81.

As shown in FIG. 34, an exciting electrode 84 is formed on the side surface 81*e* of the dielectric block 81 which is in contact with the edge 81*c*; an exciting electrode 85 is formed on the side surface 8 if of the dielectric block 81 which is in contact with the edge 81*d*. These exciting electrodes 84 and 85 are prevented from contacting the metal plate 83 by the removed portions 87 and 88, respectively. No metal plate or electrode is formed on the remaining surfaces of the dielectric block 81 which, therefore, constitute open ends.

In actual use, the metal plate 82 formed on the top surface of the dielectric block 81 is floating and the metal plate 83 formed on the bottom surface of the dielectric block 81 is grounded similar to the bandpass filter 10. One of the exciting electrodes 84 and 85 is used as an input electrode, and the other is used as an output electrode.

In the bandpass filter 80 of this embodiment, although the exciting electrodes 84 and 85 are formed on the side surfaces of the dielectric block 81, the exciting electrodes 84 and 85 can be directly connected to the electrodes formed on the printed circuit board by using solder or the like1 without using wires, because the exciting electrodes 84 and 85 are in contact with the edges (81*c* and 81*d*) of the bottom surface of the dielectric block 81. That is, the bandpass filter 80 can be used as a SMD.

In this embodiment, although the triangular removed portion 86 is formed at the upper left corner of the metal plate 83, the position, shape and number of the removed portion 86 are not limited as explained with reference to FIGS. 11 to 19.

Further, in this embodiment, although the symmetry of the resonator structure of each mode is destroyed by using the removed portion 86, the symmetry can be destroyed by removing the corner of the dielectric block 81 similar to the bandpass filter 70 shown in FIG. 32.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the dielectric blocks for the resonators and the evanescent waveguide are made of a dielectric material whose dielectric constant, $\square_r$ is 33. However, a material having a different dielectric constant can be used according to the intended purpose.

further, the dimensions of the dielectric blocks, metal plates and exciting electrodes specified in the above-described embodiments are only examples. Dielectric blocks, metal plates and exciting electrodes having different dimensions can be used according to intended purposes.

Because, as described above, in the bandpass filter according to the present invention, the top surface of the dielectric block is substantially entirely covered with the metal plate of a floating state, the radiation loss can be reduced.

Further, in the case where the exciting electrodes are disposed on the bottom surface of the dielectric block, the thickness thereof and the area required for mounting can be reduced. In this case, because the sufficient external circuit coupling can be obtained, a very thin shape and broadband operation can be achieved simultaneously.

Therefore, the present invention provides a bandpass filter that can be preferably utilized in communication terminals such as mobile phones and the like, Wireless LANs (Local Area Networks), and ITS (Intelligent Transport Systems) and the like.

What is claimed is:

1. A bandpass filter of dual mode comprising:

a dielectric block having a top surface, a bottom surface and first to fourth side surfaces;

a first metal plate to be in a floating state substantially entirely formed on the top surface of the dielectric block;

a second metal plate to be grounded formed on the bottom surface of the dielectric block; and means for providing coupling between the dual modes, the providing means being achieved by a removed portion exposing a part of the bottom surface of the dielectric block.

2. The bandpass filter as claimed in claim 1, wherein the dielectric block has substantially rectangular prismatic shape.

3. The bandpass filter as claimed in claim 2, further comprising a first exciting electrode and a second exciting electrode formed on the bottom surface of the dielectric block.

4. The bandpass filter as claimed in claim 2, further comprising a first exciting electrode formed on the first side surface of the dielectric block and a second exciting electrode formed on the second side surface adjacent to the first side surface of the dielectric block.

5. The bandpass filter as claimed in claim 1, wherein the removed portion is positioned at a corner of the second metal plate.

6. The bandpass filter as claimed in claim 1, wherein the removed portion is positioned at an inner location of the second metal plate.

7. The bandpass filter as claimed in claim 1, wherein the removed portion has a triangular shape.

8. The bandpass filter as claimed in claim 1, wherein the removed portion has a rectangular shape.

9. The bandpass filter as claimed in claim 1, wherein the removed portion is in the form of a sector.

10. The bandpass filter as claimed in claim 1, wherein the removed portion has a circular shape.

11. The bandpass filter as claimed in claim 1, wherein there are a plurality of removed portions.

12. A bandpass filter comprising:

a dielectric block having a top surface, a bottom surface and first to fourth side surfaces;

a first metal plate to be in a floating state substantially entirely formed on the top surface of the dielectric block;

a second metal plate to be grounded formed on the bottom surface of the dielectric block; and means for providing coupling between the dual modes, the providing means being achieved by a coupling control stub formed on the bottom surface of the dielectric block and physically connected to the second metal plate.

13. The bandpass filter as claimed in claim 12, wherein the coupling control stub has a rectangular shape.

14. The bandpass filter as claimed in claim 12, wherein the coupling control stub has a triangular shape.

15. The bandpass filter as claimed in claim 12, wherein the coupling control stub has a circular shape.

16. The bandpass filter as claimed in claim 12, wherein the providing means is also achieved by a removed portion exposing a part of the bottom surface of the dielectric block.

17. A bandpass filter of dual-mode comprising:

a dielectric block having a top surface, a bottom surface and first to fourth side surfaces;

a first metal plate to be in a floating state substantially entirely formed on the top surface of the dielectric block:

a second metal plate to be grounded formed on the bottom surface of the dielectric block, the second metal plate being in contact with a first edge of the bottom surface and a second edge of the bottom surface adjacent to the first edge;

means for providing coupling between the dual modes; and a first exciting electrode and a second exciting electrode formed on the bottom surface of the dielectric block, the first exciting electrode being further in contact with the first edge and the second exciting electrode being further in contact with the second edge, the first exciting electrode being in contact with a third edge of the bottom surface opposite to the second edge, and the second exciting electrode being in contact with a forth edge of the bottom surface opposite to the first edge.

18. The bandpass filter as claimed in claim 17, wherein no metal plate is formed on any one of the first to fourth side surfaces of the dielectric block.

19. A bandpass filter of dual-mode comprising:

a dielectric block having a top surface, a bottom surface and first to fourth side surfaces;

a first metal plate to be in a floating state substantially entirely formed on the top surface of the dielectric block;

a second metal plate to be grounded formed on the bottom surface of the dielectric block;

means for providing coupling between the dual modes; and a first exciting electrode formed on the first side surface of the dielectric block and a second exciting electrode formed on the second side surface adjacent to the first side surface of the dielectric block, the first exciting electrode being prevented from contacting the second metal plate by a first removed portion exposing a part of the bottom surface of the dielectric block formed along a first edge between the bottom surface and the first side surface of the dielectric block, and the second exciting electrode being is prevented from contacting the second metal plate by a second removed portion exposing another part of the bottom surface of the dielectric block formed along a second edge between the bottom surface and second side surface of the dielectric block.

20. The bandpass filter as claimed in claim 19, wherein the providing means is achieved by a third removed portion exposing still another part of the bottom surface of the dielectric block.

21. The bandpass filter as claimed in claim 19, wherein a dimension of each the top and bottom surface of the dielectric block is square.

22. A bandpass filter of dual-mode, comprising:

a dielectric block having a top surface, a bottom surface and first to fourth side surfaces;

a first metal plate to be in a floating state substantially entirely formed on the top surface of the dielectric block;

a second metal plate to be grounded formed on the bottom surface of the dielectric block; and means for providing coupling between the dual modes, the providing means being achieved by removing a corner of the dielectric block.

23. The bandpass filter as claimed in claim 22, further comprising a first exciting electrode and a second exciting electrode formed on the bottom surface of the dielectric block.

24. The bandpass filter as claimed in claim 23, wherein no metal plate is formed on any one of the first to fourth side surfaces of the dielectric block.

25. A bandpass filter of dual-mode comprising:

a dielectric block having a top surface, a bottom surface and first to fourth side surfaces;

a first metal plate formed on the top surface of the dielectric block;

a second metal plate formed on the bottom surface of the dielectric block;

first and second exciting electrodes formed on the bottom surface of the dielectric block; and means for providing a coupling between the dual modes, the providing means being achieved by a removed portion exposing a part of the bottom surface of the dielectric block.

26. The bandpass filter as claimed in claim 25, wherein the dielectric block has substantially rectangular prismatic shape.

27. A bandpass filter as claimed in claim 25, wherein no metal plate is formed on any one of the first to fourth side surfaces of the dielectric block.

28. A bandpass filter as claimed in claim 25, wherein a dimension of each the top and bottom surface of the dielectric block is square.

29. A bandpass filter of dual-mode, comprising:

a dielectric block having a top surface, a bottom surface and first to fourth side surfaces;

a first metal plate formed on the top surface of the dielectric block;

a second metal plate formed on the bottom surface of the dielectric block;

first and second exciting electrodes formed on the bottom surface of the dielectric block, and means for providing coupling between the dual modes, the providing means being achieved by a coupling control stub formed on the bottom surface of the dielectric block and physically connected to the second metal plate.

30. The bandpass filter as claimed in claim 29, wherein the dielectric block has substantially rectangular prismatic shape.

31. A bandpass filter as claimed in claim 29, wherein no metal plate is formed on any one of the first to fourth side surfaces of the dielectric block.

32. A bandpass filter as claimed in claim 29, wherein a dimension of each the top and bottom surface of the dielectric block is square.

33. A bandpass filter of dual-mode, comprising:

a dielectric block having a top surface, a bottom surface and first to fourth side surfaces;

a first metal plate formed on the top surface of the dielectric block;

a second metal plate formed on the bottom surface of the dielectric block;

first and second exciting electrodes formed on the bottom surface of the dielectric block, and means for providing coupling between the dual modes, the providing means being achieved by removing a corner of the dielectric block.

34. The bandpass filter as claimed in claim 33, wherein the dielectric block has substantially rectangular prismatic shape.

35. A bandpass filter as claimed in claim 33, wherein no metal plate is formed on any one of the first to fourth side surfaces of the dielectric block.

36. A bandpass filter as claimed in claim 33, wherein a dimension of each the top and bottoms surface of the dielectric block is square.

* * * * *